US007794291B2

(12) United States Patent
Goch

(10) Patent No.: US 7,794,291 B2
(45) Date of Patent: Sep. 14, 2010

(54) ELECTRICAL TRANSMISSION LINE REPAIR SERVICE

(75) Inventor: Waymon P. Goch, Clinton, OH (US)

(73) Assignee: Classic Connectors, Inc., Clinton, OH (US)

( * ) Notice: Subject to any disclaimer, the term of this patent is extended or adjusted under 35 U.S.C. 154(b) by 0 days.

(21) Appl. No.: 11/859,924

(22) Filed: Sep. 24, 2007

(65) Prior Publication Data

US 2009/0081909 A1 Mar. 26, 2009

(51) Int. Cl.
*H01R 11/09* (2006.01)

(52) U.S. Cl. ..... 439/797; 29/868

(58) Field of Classification Search ..... 439/786–798, 439/801, 784, 806, 805, 807, 810–815; 29/868, 29/869, 871, 872, 873
See application file for complete search history.

(56) References Cited

U.S. PATENT DOCUMENTS 3,287,491 A * 11/1966 Hubbard et al. ..... 174/138 R
3,614,700 A * 10/1971 Beard et al. ..... 337/203
4,323,722 A 4/1982 Winkelman
4,661,662 A * 4/1987 Finke et al. ..... 200/48 R
4,795,365 A * 1/1989 Johnston et al. ..... 439/411
5,581,051 A * 12/1996 Hill ..... 174/138 R
6,322,378 B1 * 11/2001 Auclair ..... 439/99
6,773,311 B2 * 8/2004 Mello et al. ..... 439/783
7,220,067 B2 5/2007 Rubinstein et al.
2003/0019099 A1 1/2003 Carter et al.
2005/0213898 A1 9/2005 Rubinstein et al.
2006/0084327 A1 4/2006 Chadbourne
2006/0105639 A1 5/2006 Tamm
2007/0066153 A1 3/2007 De France et al.

OTHER PUBLICATIONS

Reding, JL, "Investigation of Thrasher Compression Fittings on BPA's Direct Current Transmission Line," IEEE Transactions on Power Delivery, vol. 6, No. 4, Oct. 1991.
Preformed Line Products, catalog, pp. 7-2 through 7-7, undated.
Institute of Electrical and Electronics Engineers, Inc., IEEE P1283_2008/D0.0, Revised Guide for Determining the Effects of High Temperature Operation on Conductors, Connectors, and Accessories, Draft 0.0, Jun. 2004, (pp. 1-23).
JL Reding, Investigation of Thrasher Compression Fittings on BPA's Direct Current Transmission Line, IEEE Transactions on Power Delivery, vol. 6, No. 4, Oct. 1991, (pp. 1616-1622).
Jerry Reding, Guide for Determining the Effects of High-Temperature Operation on Conductors, Connectors, and Accessories, dated Apr. 2007, (pp. 1-29).

* cited by examiner

*Primary Examiner*—Ross N Gushi
(74) *Attorney, Agent, or Firm*—The Watson I.P. Group, PLC; Jovan N. Jovanovic; Vladan M. Vasiljevic

(57) ABSTRACT

An electrical conductor repair device for restoring mechanical and electrical integrity to a compromised section of an electrical conductor. The device includes a body that serves as an electrical shunt and a mechanical support. The body includes a first end section for attachment to the conductor at a location on one side of the compromised section, and a second end section for attachment to the conductor at a location on the other side of the compromised section. The end sections are connected by an intermediate section.

17 Claims, 22 Drawing Sheets

ELECTRICAL TRANSMISSION LINE REPAIR SERVICE

FIELD OF THE INVENTION

The present disclosure generally relates to electrical transmission and distribution line repair and reinforcement devices. In particular, the present disclosure relates to devices that restore mechanical and/or electrical integrity to electrical conductors, connectors and clamps of a transmission or distribution system.

BACKGROUND OF THE INVENTION

Electrical transmission and distribution systems of the common overhead type include a plurality of electrical conductors. The electrical conductors are typically bare and are supported by insulating means attached to a pole or other suitable structure to suspend or support the conductors a safe distance above the reach of normal ground traffic and machinery. A variety of connectors are employed in the construction of such systems including splices, dead-ends, taps and terminals. Of these, splices and dead-end connectors are utilized in tension applications. Such connectors provide not only electrical continuity to conductors joined thereby, but also the mechanical means to support the conductor under tension to traverse the span between support structures.

A variety of conductor configurations exist and the two principal types of conductors utilized in the modern electrical grid are copper and aluminum. Some common types of conductors are stranded aluminum alloy conductors (AAC), all aluminum alloy conductors (AAAC) and aluminum conductors steel reinforced (ACSR). The conductors and connectors used in tensioned electrical transmission systems and lines have a finite electrical and mechanical service life. For example, the electrical interface of all conductors and connectors is subject to a variety of aging phenomena, which serve to degrade the interface and increase the electrical resistance thereof over time. This aging effect can be accelerated by many factors, such as increased operation temperature, improper installation and adverse environmental conditions.

A reasonable service life for aluminum connectors of the type used in overhead distribution and transmission applications, when properly assembled with the appropriate inhibitor and operated within their thermal design limitations, is proving to be approximately 40 to 60 years. However, aluminum connectors that are operated in corrosive environments, at elevated thermal levels or those improperly installed, tend to fail in less than 25 years, sometimes in as little as 15 years, and often in as little as 5 years.

The use of aluminum conductors and connectors in the electrical power grid became prevalent during World War II, when shortages of copper forced utilities to seek alternate means to transfer electric current. Engineering breakthroughs resulted in superior conductors based on aluminum stranding, utilizing hard drawn alloys, tempered alloys, and composite conductor constructions having steel cores to reinforce their tensile properties. At the end of the war, an improved economy and technology fueled a major focus on construction, resulting in electrification of the greater parts of Europe and North America, as well as other parts of the world. Thus, the major portions of the electrical grid in place today were built between the late 1940's and the early 1970's, the results being that the majority of our existing electrical infrastructure is 35 to 60 years old. As previously stated, a reasonable service life for aluminum connectors used in overhead distribution and transmission is proving to be approximately 40 to 60 years, while the conductor remains usable for possibly another 20 years or more. Currently, the connectors are beginning to fail at an alarming rate.

The advent of increasing power demands in recent decades combined with the construction of new power lines lagging severely behind the construction of a new generation of new homes, businesses and industries has resulted in operating the existing grid at an ever increasing electrical current load. Consequently, these higher electrical current levels result in much higher conductor and connector temperatures. This increase in electrical load on the transmission and distribution infrastructure serves to amplify the current density and thermal stress on the entire system. These are just some of the factors that are serving to accelerate the inevitable failure of millions of electrical connectors that are already in the latter stages of their service life.

Additionally, a number of these aluminum bodied tension connectors have particular thermal limitations, typically about 93° C. When the thermal limitation is exceeded, the tempered aluminum alloys anneal, resulting in a loss of tensile properties on an order of about 65% to 70% of their original ultimate design strength. A great number of these types of connectors have already failed catastrophically due to operation of the line beyond their design limits.

Connectors that serve both as mechanical tension anchors and electrical connectors are particularly prone to fail catastrophically. The failure of such connectors results in energized power lines falling into and onto the general public, power outages and in some cases, property damage or severe personal injury and death.

One option is to construct new power transmission and distribution systems. Another option is to replace the old conductors and connectors with new ones that operate at temperatures as high as 250° C. However, right of way for new structures has become increasingly difficult or impossible to obtain, and replacement of existing conductors and connectors is not economically justifiable when the existing conductor still may have 20 to 30 years of usable life.

As to failing connectors, one option is to replace the connectors. This is an extremely expensive undertaking. The process typically includes interrupting power, cutting out the failed connector and replacing it with two new connectors and a length of conductor. In some instances, to avoid using two new connectors and an additional length of conductor, a single extended length replacement connector is employed. Installation of the single extended length connector is also an expensive and time consuming undertaking.

Furthermore, on critical service lines where an interruption cannot be tolerated, an electrical jumper must be attached, followed by attachment of a mechanical device to support the conductor while the replacement process is performed on the energized conductor. This is even more expensive, typically priced in the thousands of dollars per connector, and is obviously extremely dangerous.

Another possibility is to build a shunt system around a connector by utilizing two tee type tap connectors attached to the conductor on each respective end of the failing connector. A jumper is then attached between these tap connectors. While this addresses the electrical interface, it does not address the weakened mechanical condition of the connector. Thus, there would still be a significant risk of mechanical failure.

SUMMARY OF THE INVENTION

In accordance with one aspect of the present disclosure, a device for restoring electrical and mechanical integrity to a compromised section of an electrical transmission line is provided. The device includes a body that serves as an electrical shunt and a mechanical support for the compromised section of the electrical transmission line. The body includes a first end section which is attached to the transmission line at a location on one side of the compromised section. The body also includes a second end section which is attached to the transmission line at a location on the other side of the compromised section.

In accordance with another aspect of the present disclosure, an electrical connector repair device is provided. The device includes a first clamping end, a second clamping end and an intermediate portion. The first clamping end is configured to be clamped onto a first conductor section located on one side of the compromised connector, and the second clamping end is configured to be clamped onto a second conductor section located on the other side of the compromised connector. The device provides a path for electrical current therethrough and has sufficient strength to support the connector.

In yet another aspect, a method for repairing transmission lines is provided. The method includes the steps of attaching a first end of a shunt device to a first portion of a transmission, attaching a second end of the shunt device to a second portion of the transmission line, and supporting a compromised section of the transmission line with the shunt device.

Accordingly, one object of the present disclosure is a repair device that bypasses the electrical interface of an aged electrical connector without the need to remove the connector or otherwise break the mechanical and electrical integrity of the circuit conductor.

Another object of the present disclosure is a repair device that will restore the full mechanical integrity to the system without the need to replace the aged connector.

A further object of the present disclosure is a repair device that is easily and readily installed by a lineman, using a minimal amount of the tools readily available.

A further object of the present disclosure is a repair device that is easily and readily installed by a lineman, on an energized circuit with no need to de-energize said circuit.

A further object of the present disclosure is a repair device that restores the mechanical integrity to dead-end connectors as well as splices.

A further object of the present disclosure is a repair device that is suitable for use on a plurality of connector styles including splices, dead-ends and tap connectors.

A further object of the present disclosure is a repair device that is suitable for use on EHV circuits providing acceptable means of corona mitigation.

A further object of the present disclosure is a repair device that is suitable for use with suspension clamps, spanning to opposite sides to restore the electrical integrity to a conductor having broken strands in the proximity of the suspension clamp.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

BRIEF DESCRIPTION OF THE DRAWINGS

In describing the preferred embodiments of the present invention, reference will be made to the accompanying drawings, wherein.

DETAILED DESCRIPTION OF THE INVENTION

The repair or shunt devices described herein can be employed to restore the mechanical and electrical integrity of compromised sections of electrical transmission lines. Such compromised sections of transmission lines can include, but are not limited to, damaged or deteriorated conductors or connectors. Additionally, the devices can be used on connectors and conductors made from a variety of conductive materials, such as aluminum, copper or other metal alloys.

Figure 1:
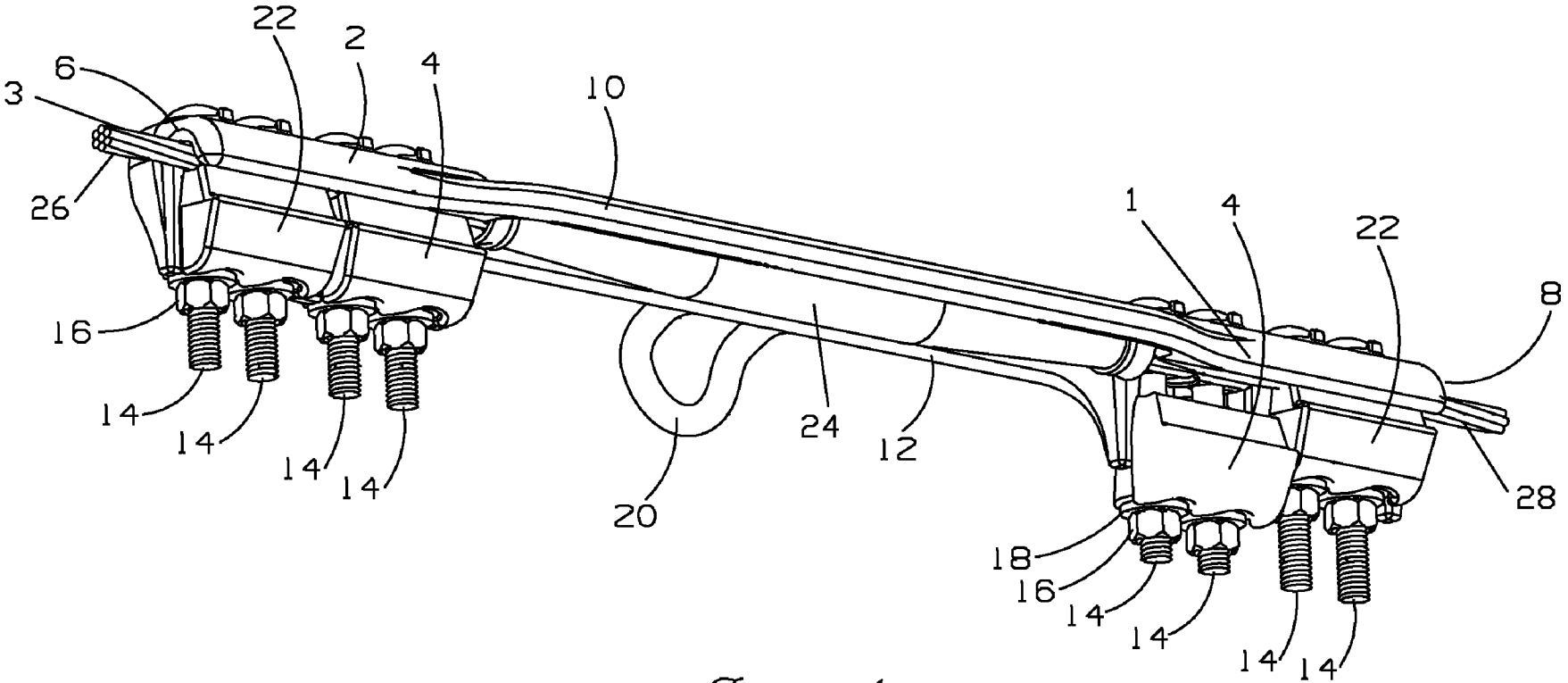
FIG. 1 is a perspective view of the repair device according to the present disclosure as viewed from underneath, in an installed position over a cable splice.
Figure 2:
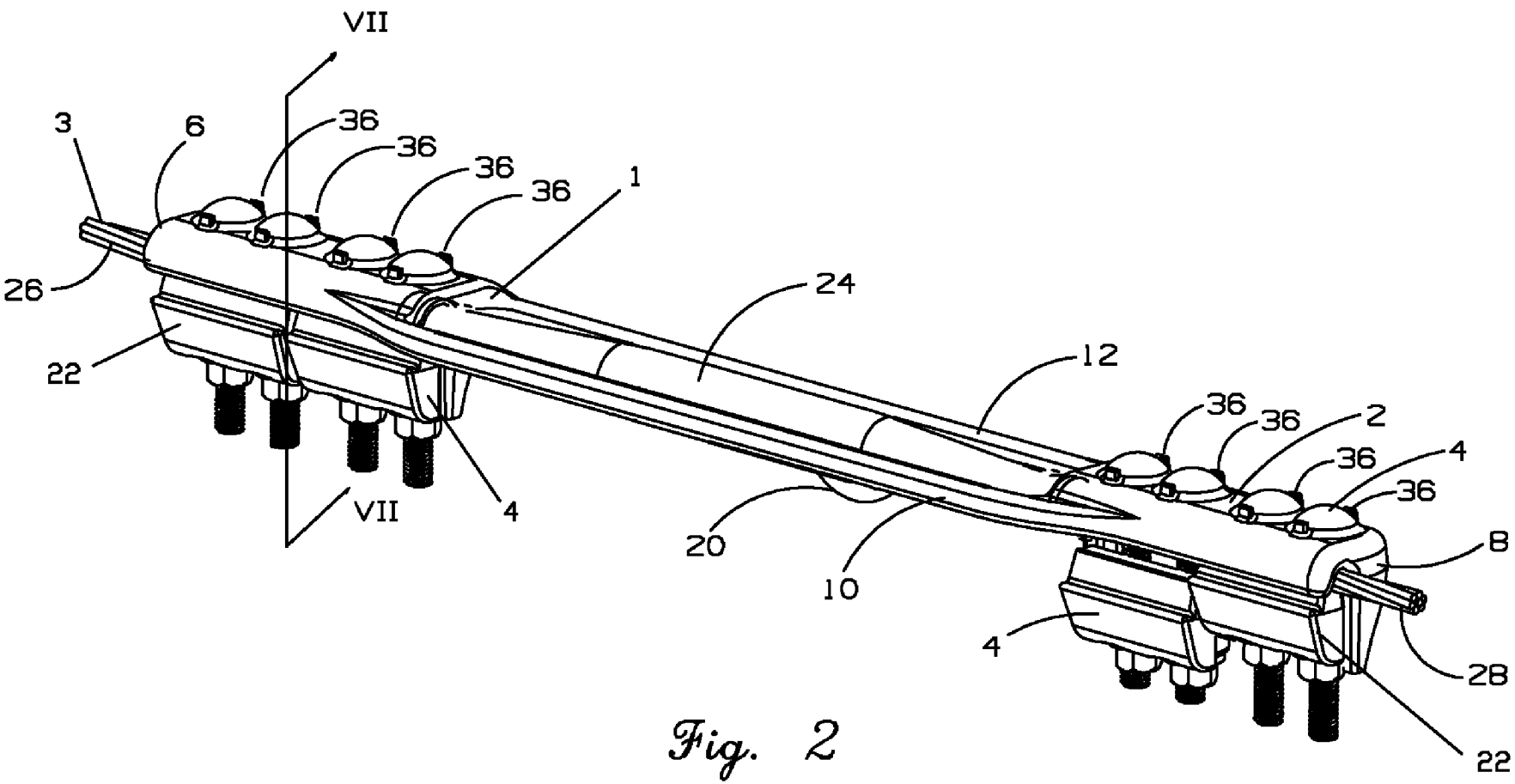
FIG. 2 is a perspective view of the device of FIG. 1 as viewed from above, in an installed position over a cable splice.
Figure 4:
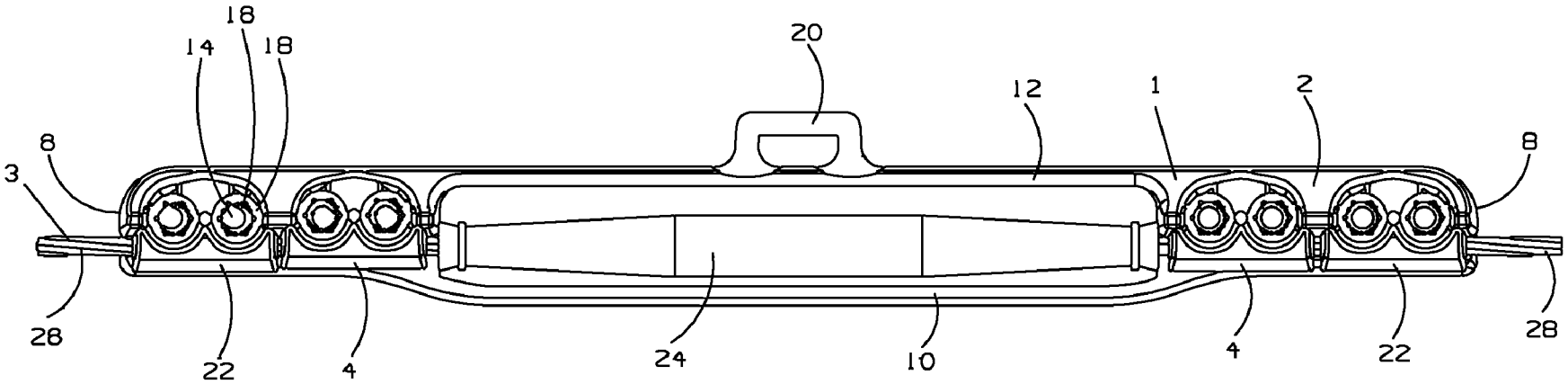
FIG. 4 is a plan bottom view of the device of FIG. 1, in an installed position over a cable splice.

FIGS. 1, 2 and 4 show one embodiment of an electrical transmission line repair device 1 installed over a compromised section of electrical transmission line 3. In the illustrated example the compromised section is a deteriorated splice 24. Repair device 1 is installed onto the electrical transmission line 3 so that the device is attached to conductors 26 and 28 which extend from splice 24. Once the repair device is installed the splice 24 is nested within the device. When installed, repair device 1 concurrently serves as an electrical shunt that provides an alternate current path and as a mechanical brace that restores or reinforces the mechanical integrity of splice 24, i.e., it supports the compromised splice.

Repair device 1 includes a body 2 made from conductive material, such as aluminum, copper or a metal alloy. The body 2 includes a first end section 6, a second end section 8 and an intermediate section between the first and second end sections. In one embodiment, first and second end sections 6 and 8 are essentially mirror images of each other. Alternatively, first and second end sections 6 and 8 can differ in structure. The intermediate section includes one or more leg members 10 and 12 that extend between first and second end sections 6 and 8. In the embodiment shown in FIGS. 1, 2, and 4-6, leg members 10 and 12 are rigid members that are integral with end sections 6 and 8 so that the body 2 is a single component. In alternative embodiments, as illustrated in FIGS. 9, 11, 12-17, 19 and 20, the leg members are individual components that are attached, by attachment mechanisms, to first and second end sections 6 and 8.

Figure 5:
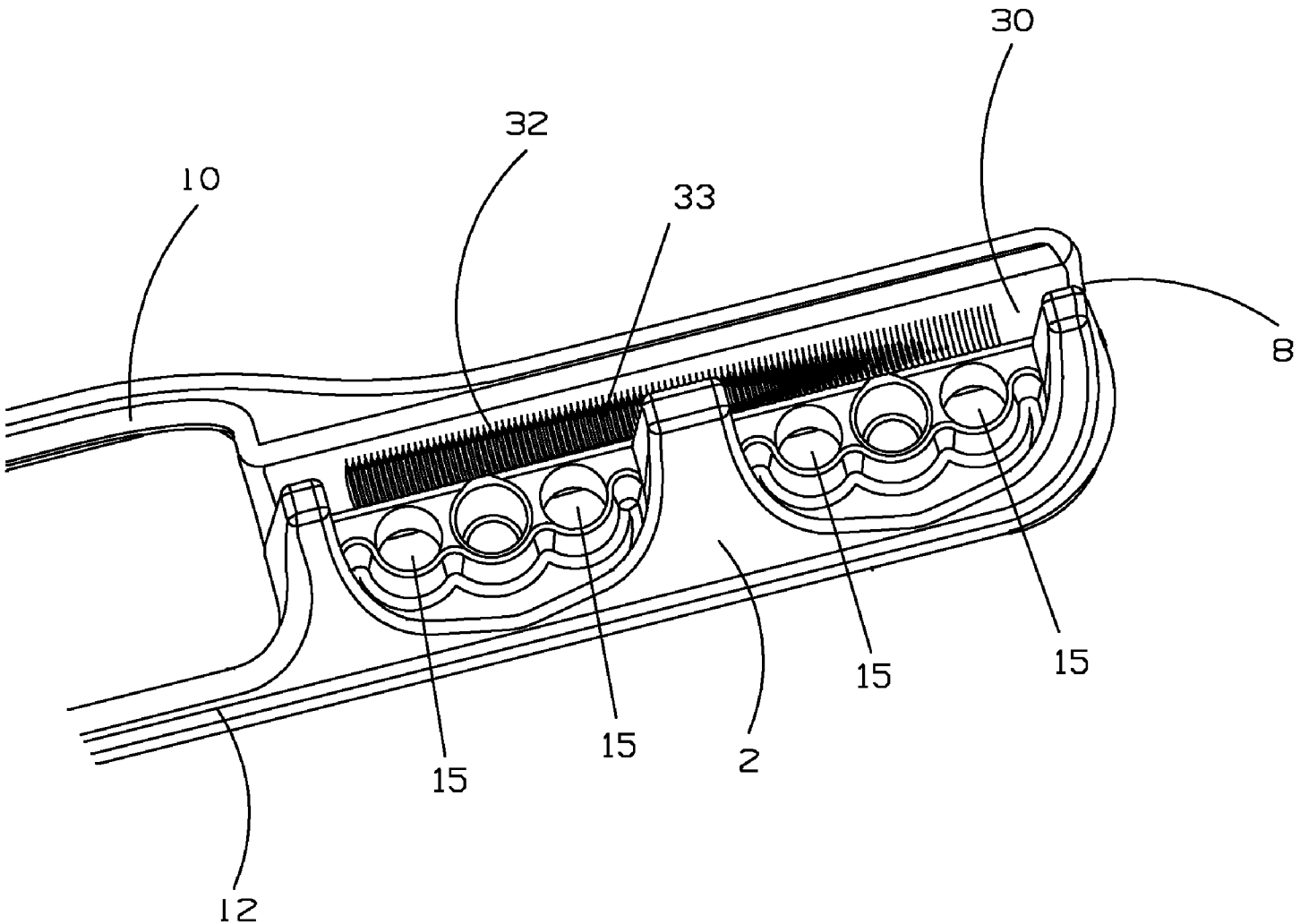
FIG. 5 is an enlarged, perspective view of one end of the device of FIG. 1 shown with the hardware and keepers removed.
Figure 6:
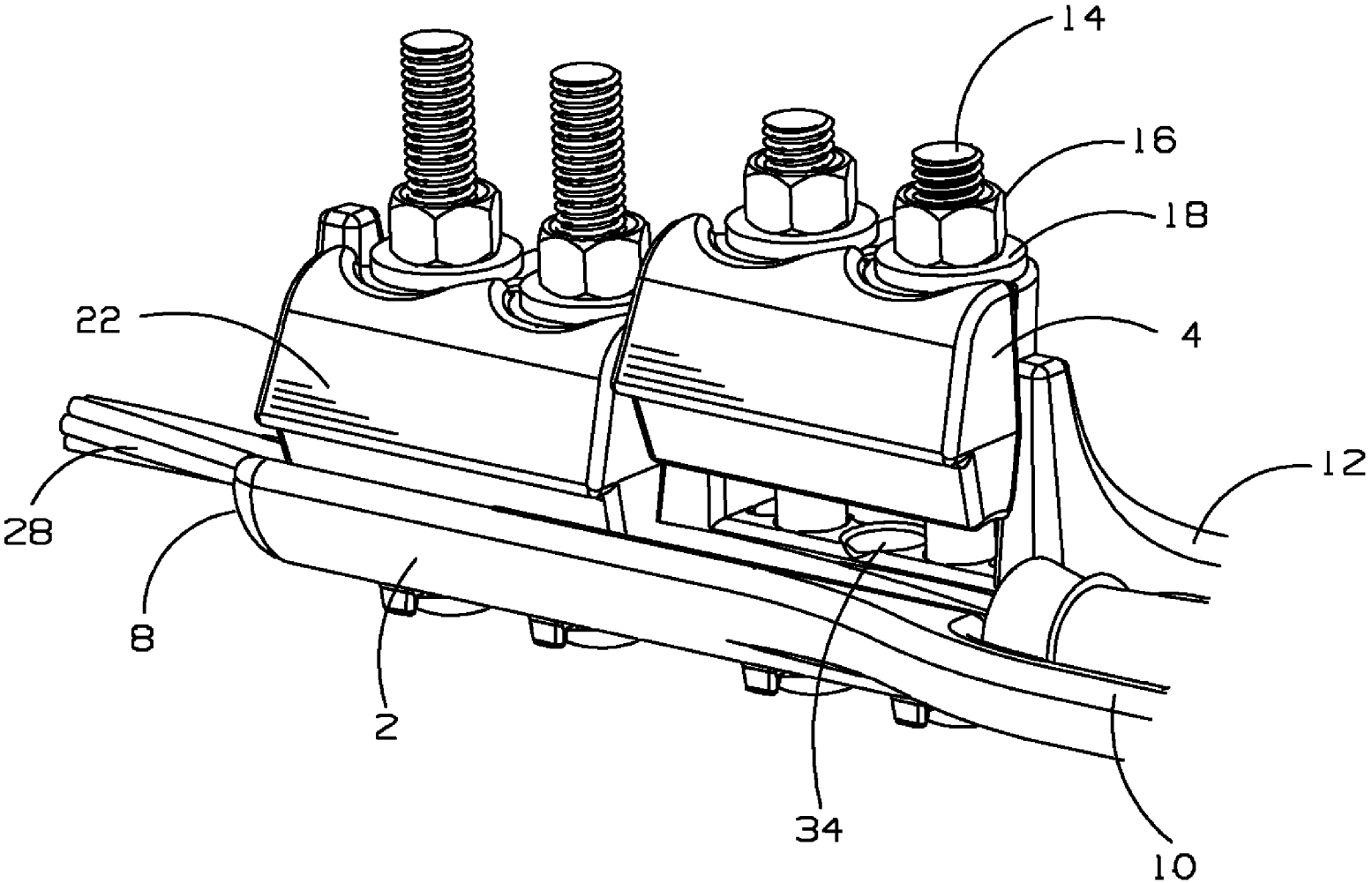
FIG. 6 is a perspective view of one end of the device of FIG. 1 shown partially installed over a cable splice.
Figure 7:
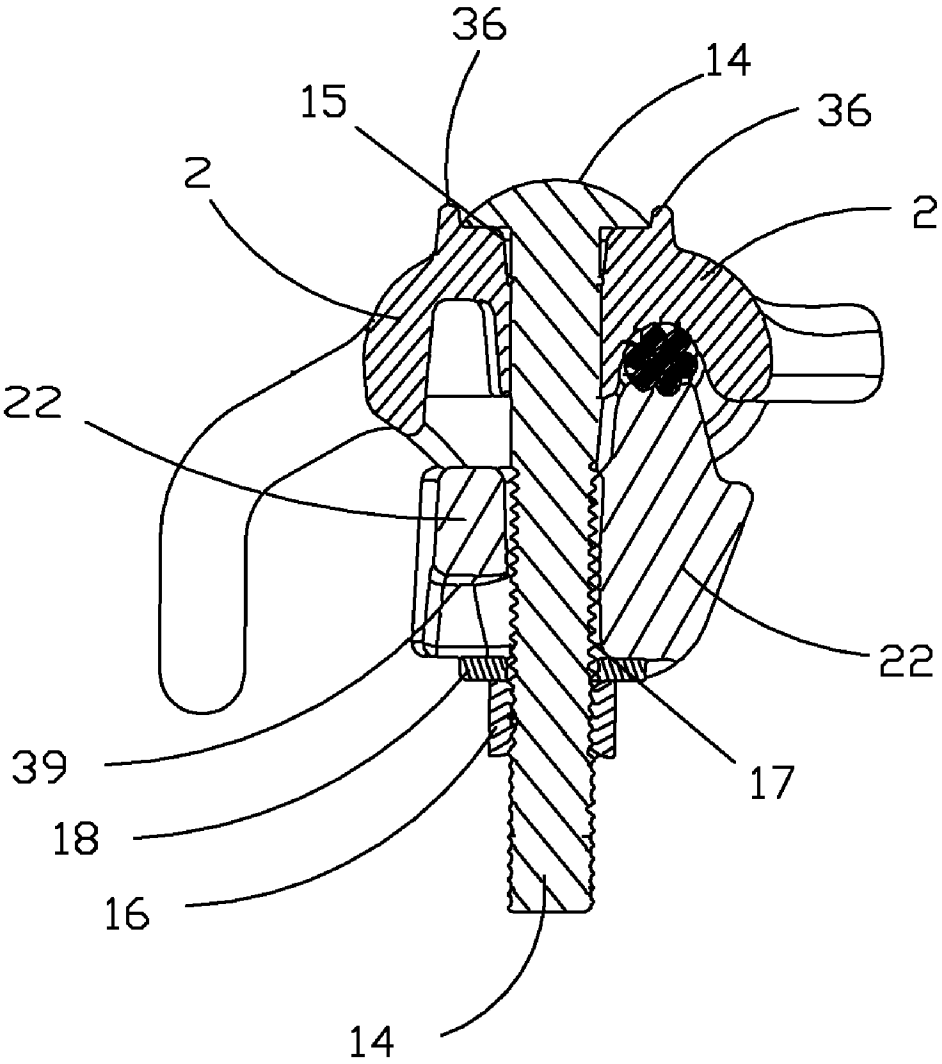
FIG. 7 is a cross-sectional view of the device of FIG. 1 taken along lines VII-VII in FIG. 2.

As illustrated in FIG. 5, end section 8 includes a conductor receiving groove 30 that is sized to receive an electrical conductor, such as a stranded conductor 28. Similarly, end section 6 also includes a conductor receiving groove. Referring to FIGS. 1, 2, 4 and 6, each of the end sections 6 and 8 also includes at least one clamping member 4. The clamping members are sometimes also referred to as keepers. In the illustrated embodiment, each end section 6 and 8 includes two clamping members, an inboard clamping member 4 and an outboard clamping member 22. In the embodiment shown in FIGS. 1, 3, 4, 6 and 7, each clamping member 4 and 22 includes one or more bolts 14, nuts 16 and washers 18, which serve to urge clamping members 4, 22 toward conductor receiving groove 30. The bolts 14 are placed through openings 15 of the body 2 (FIG. 5) and through openings 17 of clamping members 4, 22 (FIG. 7). The nuts 16 are then tightened to urge the clamping members 4, 22 toward body 2. The clamping members 4, 22 securely clamp the respective conductors 26 and 28 of transmission line 3, which are joined by splice 24, between the respective conductor receiving grooves 30 of end sections 6 and 8 and the respective clamping members 4, 22.

Figure 3:
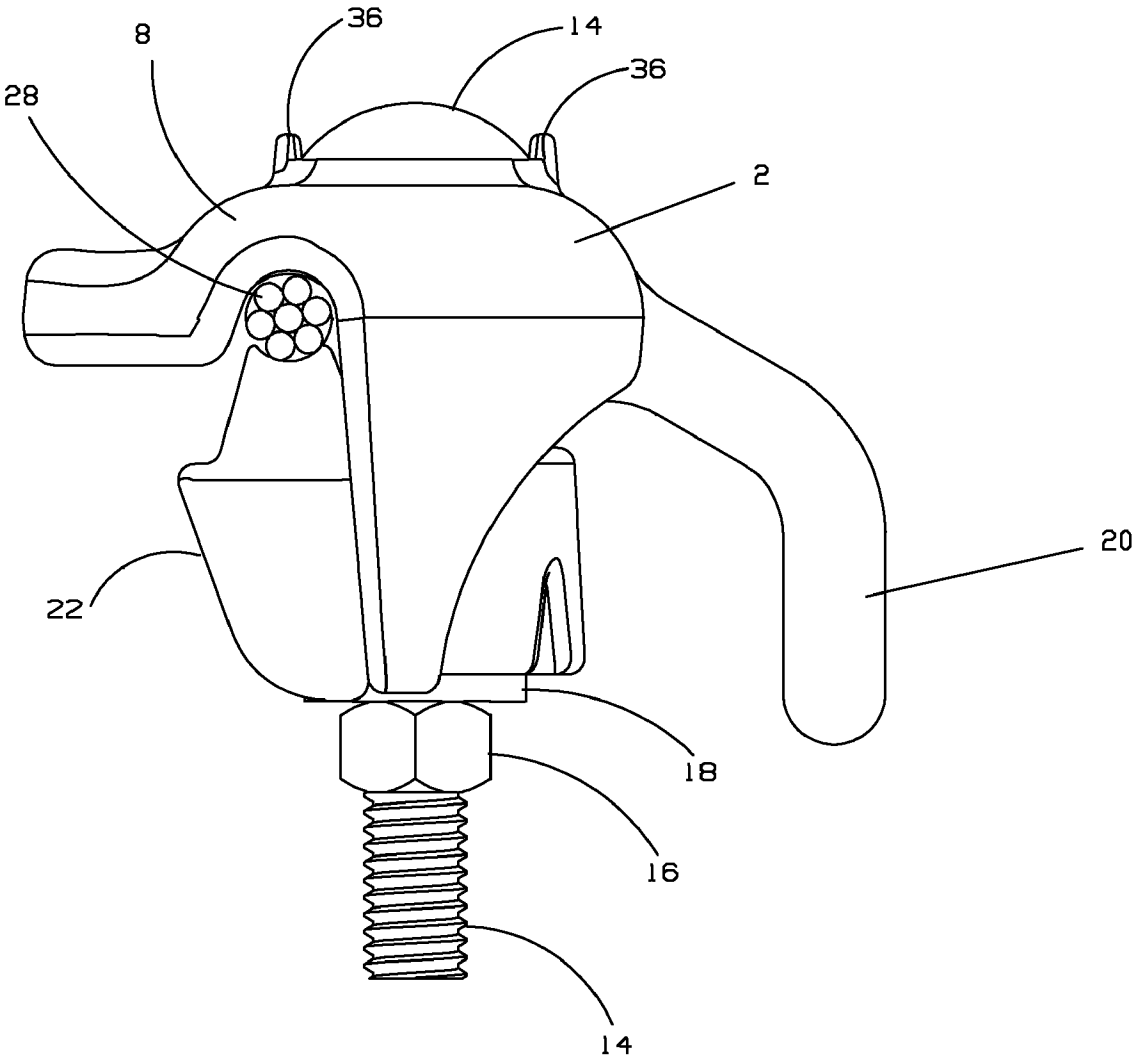
FIG. 3 is an elevation end view of the device of FIG. 1 on an enlarged scale.

As illustrated in FIGS. 2, 3, and 7, bolts 14 can be square neck carriage bolts that are held captive to body 2 by deflected ears 36. Alternately, other style bolts or fasteners can be used. For example, the fasteners can be serrated shank bolts that are pressed into the body 2, or conventional U-Bolts or other fasteners that can be pressed in or bonded in place through the use of adhesives, welding or any other suitable manner.

The clamping members can also be urged toward the body by use of other mechanisms, such as wedge or cam type members, or compression type devices that plastically deform the body onto the conductor, for example compression devices that use explosive, hydraulic or pneumatic pressure.

Repair device 1 can be installed at different orientations with respect to the transmission line. For example, device 1 can be installed with the threaded portion of bolts 14 positioned downward toward the earth and the head of the bolts positioned upward toward the sky, or vice versa. As best illustrated in FIG. 7, when device 1 is positioned with the head of the bolts upward, the rounded head of bolts 14 nested in the body 2 serve as a weather shield that protects the interface between the device and the conductor from direct impact of rain or other adverse environmental conditions. Additionally, drain grooves 39 in the clamping members 4, 22 serve to allow any accumulated moisture around the bolt to drain away. The item 34, identified in FIG. 6 (and shown in other Figures) is a pocket or depression in the body casting to contain a compression spring to hold the keepers open and facilitate installation over the conductor. In the recommended orientation (with the keepers downward), the spring would not be necessary because gravity would tend to hold them open against the lockwashers and nuts. However, since users may install the clamp assemblies in other orientations, provision has been made to incorporate the springs as an option.

Referring to FIG. 5, the conductor receiving groove 30 of each end section 6 and 8 can include a textured contact surface 33 that serves to enhance the mechanical integrity of the purchase between the device 1 and the respective conductor, to enhance the electrical contact between the device 1 and the conductor, or to enhance both the mechanical integrity and the electrical contact. Textured surface 33 can be a variety of textured surfaces, such as the illustrated teeth 32. Additionally, the contact surface, whether textured or not, can include an anti-corrosive agent that prevents or reduces corrosion of the electrical interface. The anti-corrosive agents can include chemical inhibitors, such as those in organic and synthetic oil, grease, and wax-based electrical joint compounds and sealants. The contact surface can also include a contact aid that enhances the integrity of the electrical interface. Such contact aids can include fine aluminum-nickel grit, zinc dust or any other suitable contact aid.

In one method of employing repair device 1 over a compromised section, such as a compromised splice of an electrical transmission line, the power to the electrical transmission line is interrupted. Repair device 1 is then positioned over the compromised section of the transmission line. First end section 6 of repair device 1 is attached to the line at a location on one side of the compromised section and the second end section 8 is attached to the line at a location on the other side of the compromised section. In the illustrated embodiment, the first and second end sections 6, 8 are attached to the transmission line by tightening nuts 16, thereby urging the clamping members 4, 22 toward the body 2 and securely clamping the transmission line between the clamping members 4, 22 and the body 2. Once device 1 has been installed, the power is again allowed to flow through the line and device 1 provides an electrical bridge, shunt or alternate electrical current path for the flow of current. Additionally, device 1 is of sufficient strength to support and reinforce the compromised section, so that the device will maintain mechanical integrity of the transmission line, if the compromised section were to fail.

Figure 21:
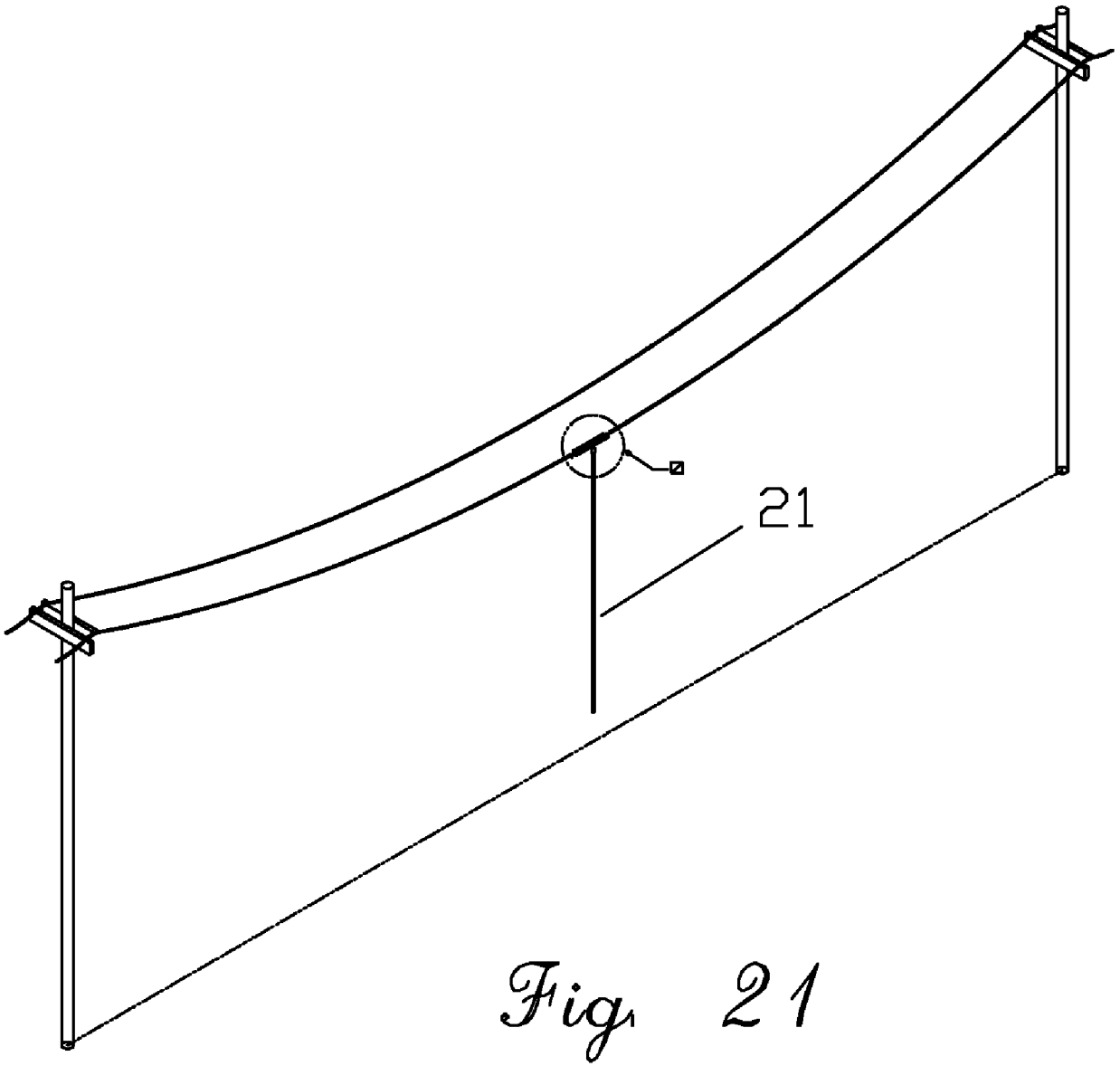
FIGS. 21 and 22 are perspective views illustrating one embodiment of the repair device being installed on a spliced conductor using a conventional lineman's tool known as a "Shotgun Stick."
Figure 22:
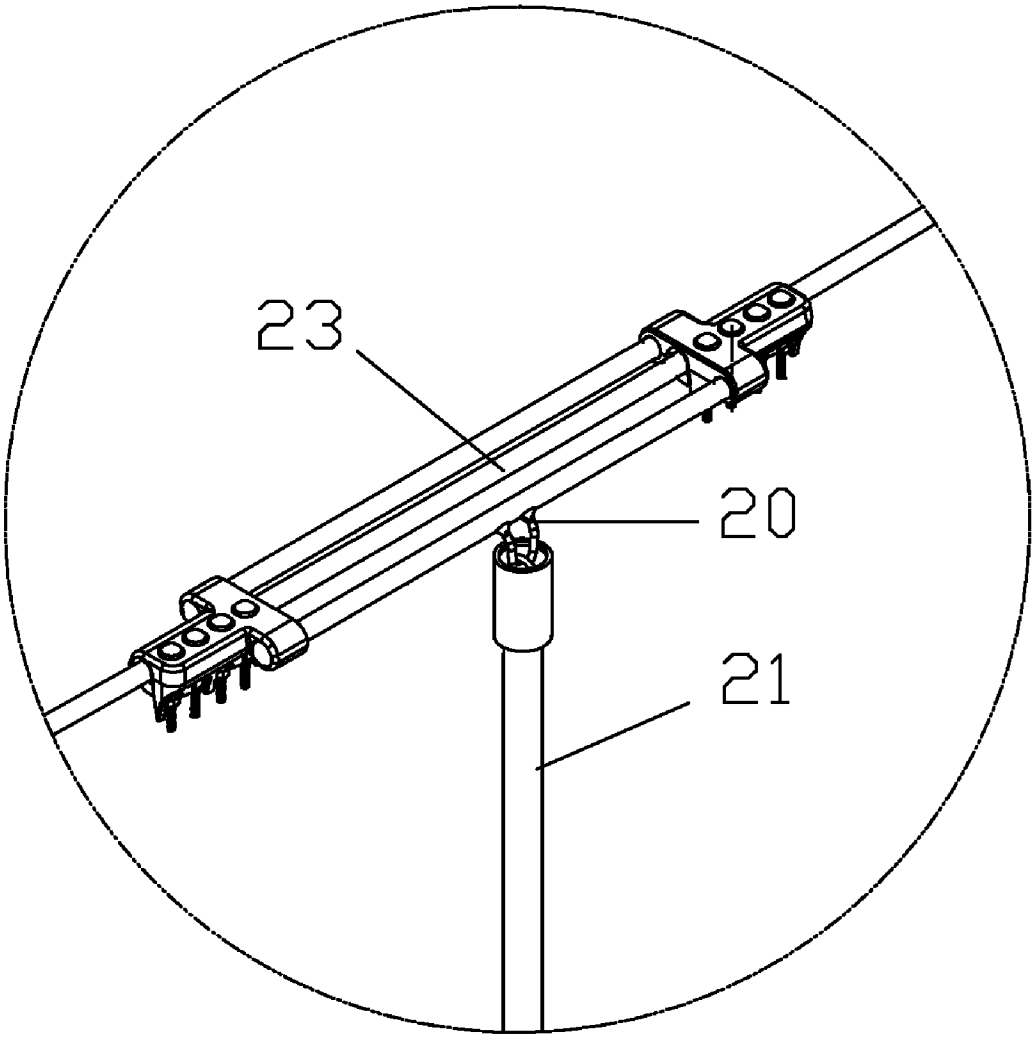

In an alternative method, the device is installed with the use of a lineman's tool known as a "Shotgun Stick" so that the device can be installed without having to interrupt power to the transmission line. As illustrated in FIGS. 21 and 22, Shotgun Stick 21 is attached to hot stick loop 20 (shown in FIG. 1). Referring to FIG. 22, while power is flowing through the line, i.e., power through the line is uninterrupted, the Shotgun Stick 21 is used to position the device over the compromised section 23 of the line. As described above, the device is positioned so that the first end section is located on one side of the compromised section and the second end section is located on the other side of the compromised section. Once positioned, the nuts 16 are tightened to clamp the respective portions of the transmission line between clamping member 4, 22 and body 2, thereby securing the device to the transmission line.

Figure 8:
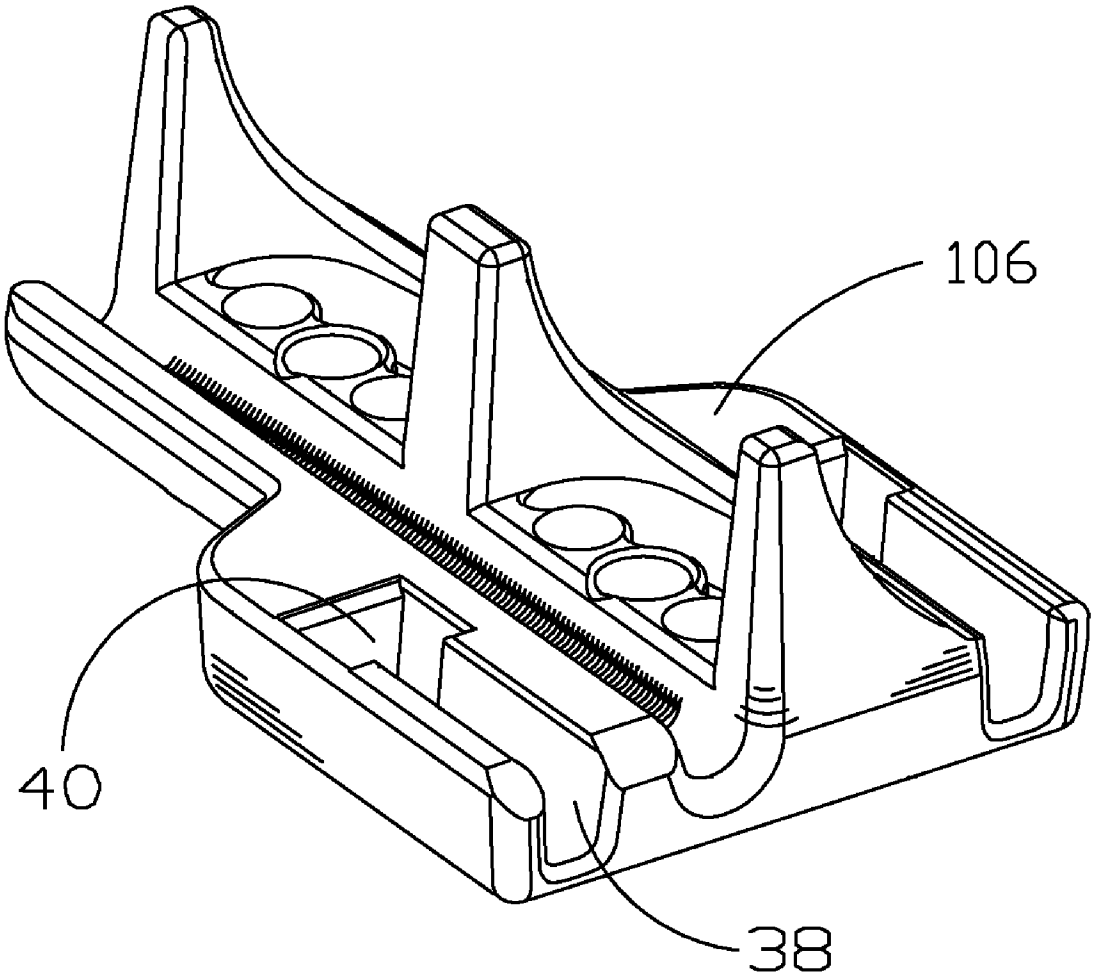
FIG. 8 is a perspective view of an end section of another embodiment of a repair device of the present disclosure.
Figure 9:
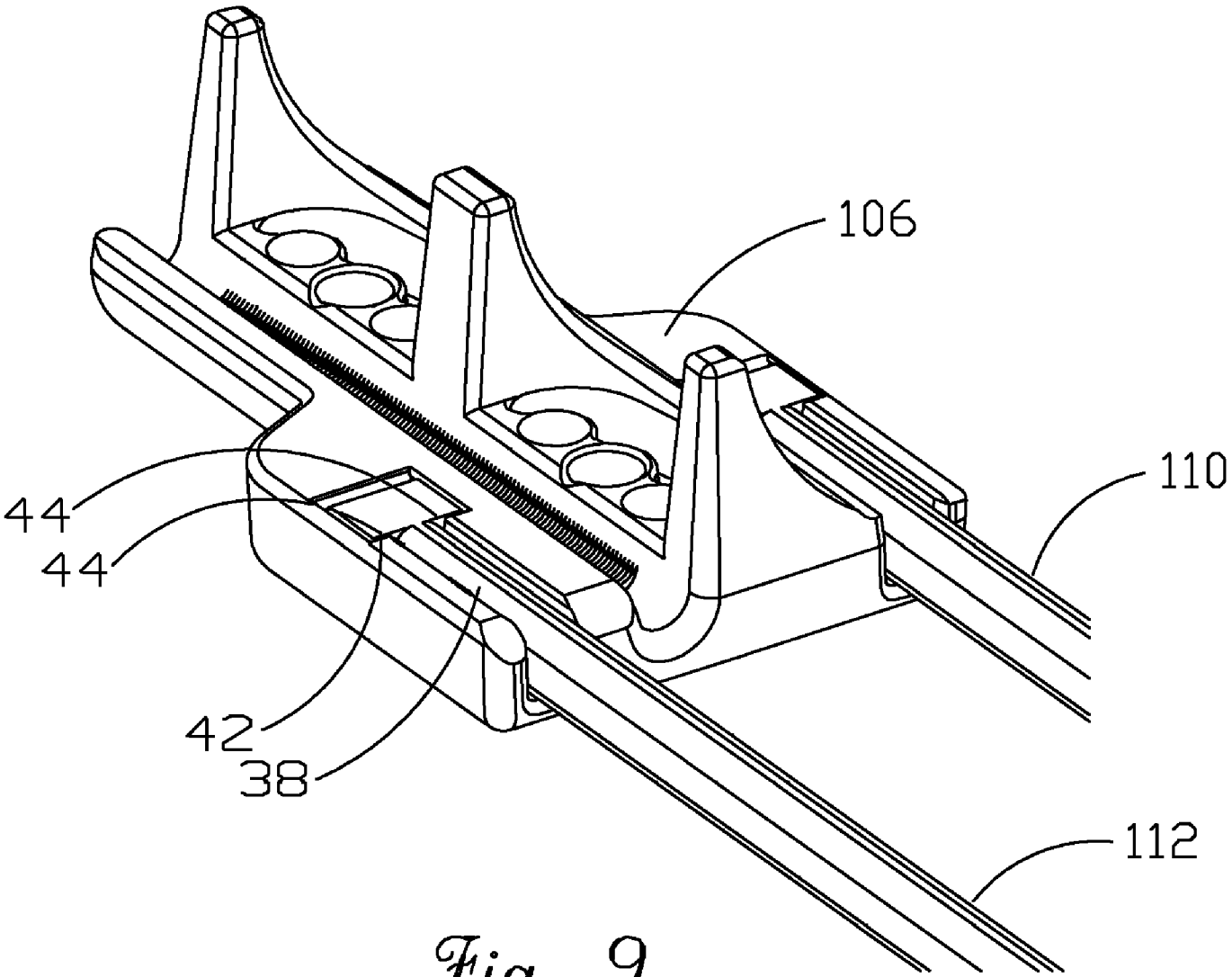
FIG. 9 is a perspective view of the end section of FIG. 8 shown with legs attached to the attachment sections.

FIGS. 8 and 9 illustrate an alternative embodiment of the end sections and leg members of the repair device. In this embodiment, the device includes a first end section 106 and a second end section (not shown). As shown, end section 106 includes a leg member attachment section 38 for attaching leg members to the end section. Attachment section 38 allows for attachment of leg members of varying lengths and properties. The attachment section 38 includes a reverse tapered receiving bore 40. As shown in FIG. 9, leg members 110 and 112 include a flared end section 42 that is received into receiving bore 40. Once the leg members 110 and 112 are assembled, flared end section 42 and the receiving bore 40 interact to withstand any tension that is applied to the leg members and the end sections. Flared end section 42 can be kept in place within receiving bore 40 by thermal fusion welding at 44. Such welding provides a non-aging electrical connection between the leg members and end portions. Furthermore, because the reverse tapered receiving bores 40 and mating flares 42 resist mechanical tension, weld 44 does not have to be relied upon to withstand mechanical tension.

Figure 10:
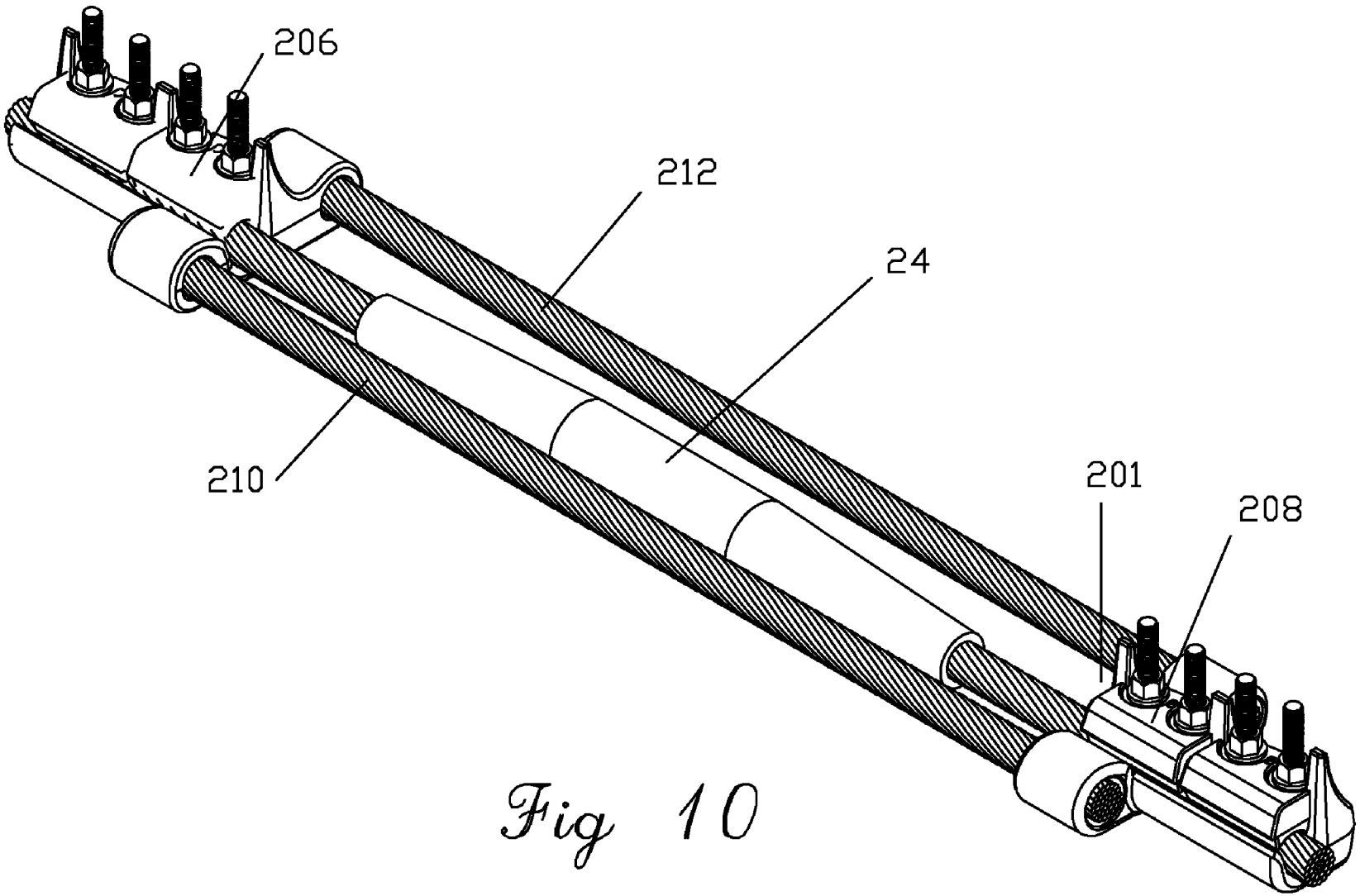
FIG. 10 is a perspective view of another embodiment of a repair device of the present disclosure, as viewed from below and installed over cable splice.

FIG. 10 illustrates another embodiment of the repair device 201 installed over splice 24 of a transmission line. Device 201 includes a first end section 206 and a second end section 208. The first and second end sections 206, 208 are connected by flexible legs 210 and 212. Flexible legs 210 and 212 allow device 201 to be bent or flexed into different configurations or at different angles. The flexible members 210 and 212 are made from conductive material, such as stranded electrical conductors, for example AAC, AAAC or ACSR, or braided straps or laminated strips of conductive material.

Figure 11:
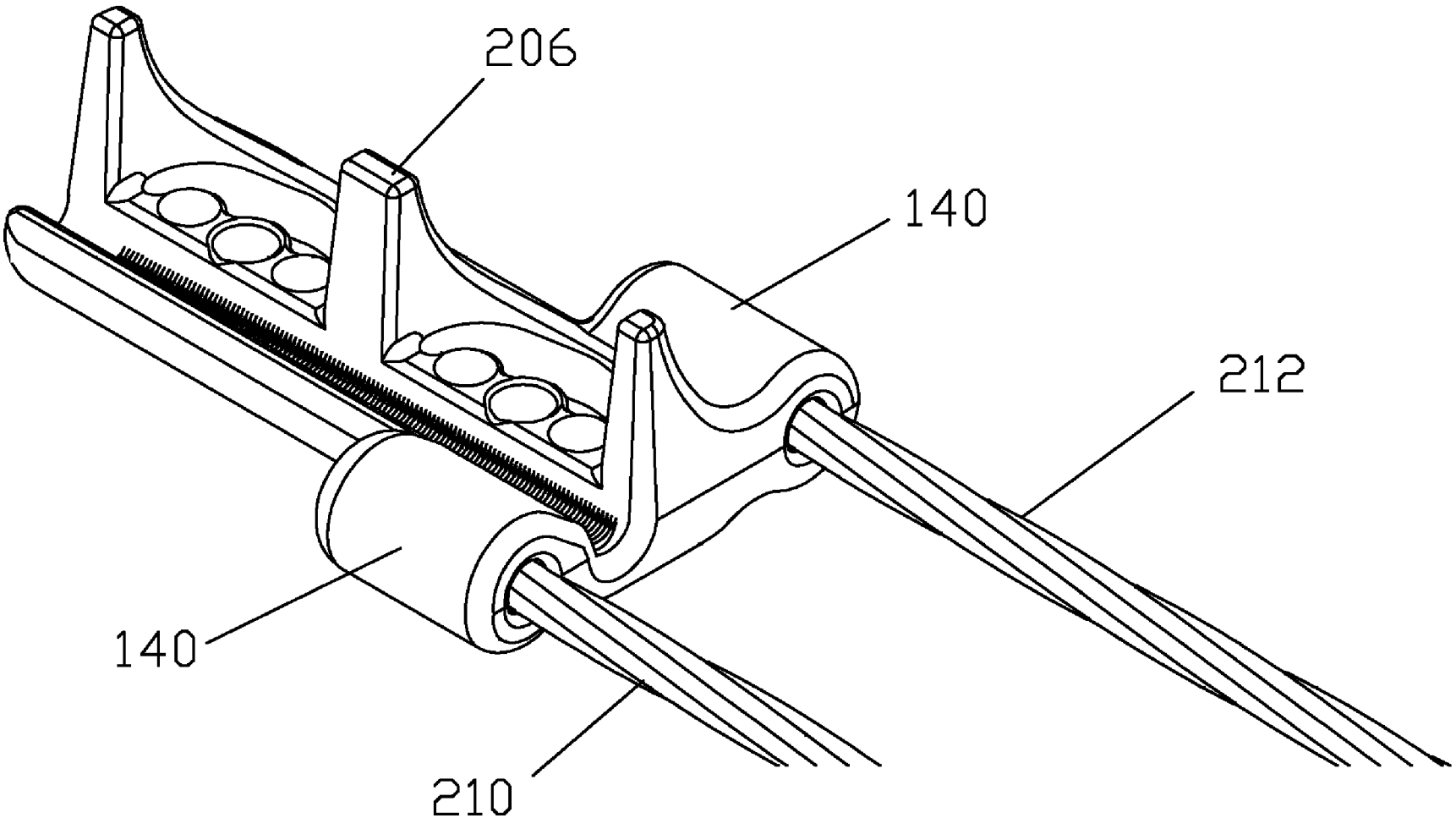
FIG. 11 is a perspective view of an end section of the device of FIG. 10.
Figure 12:
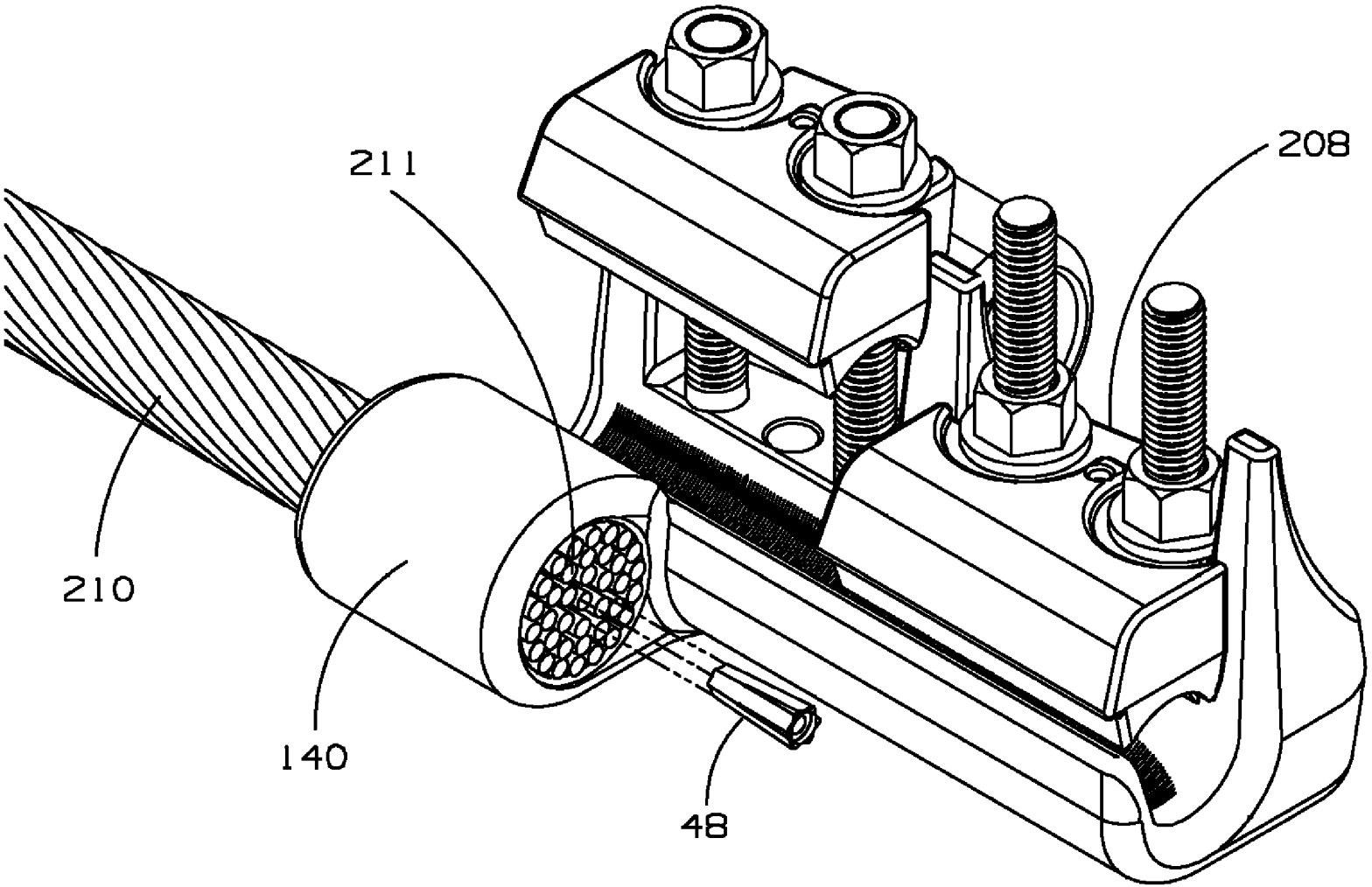
FIG. 12 is a perspective view of an end section of the device of FIG. 10.

As illustrated in FIGS. 10 and 11, flexible leg members 210 and 212 can be attached to receiving bores 140 of first and second end sections 206 and 208. Referring to FIG. 12, when flexible legs 210 and 212 are stranded conductors or cables, the conductors can be connected to receiving bores 140 by utilizing a generally conical shaped insert 48 having a hollow center. The hollow center is sized appropriately to accept the center strand of the stranded conductor. To make such attachment, the end 211 of the conductor is passed through the reverse taper receiving bore 140. Insert 48 is then inserted into the end 211 of the conductor, thereby expanding the end of the conductor to flare the end 211. The outer periphery of the flared end 211 approximately matches the reverse tapered receiving bore 140 so that when tension is applied to end sections 206 and 208, the flared end 211 securely and mechanically seats in the respective tapered receiving bore 140. Once mechanically seated, the entire end 211 is welded to provide a high integrity electrical connection and prevent inadvertent disassembly.

Figure 13:
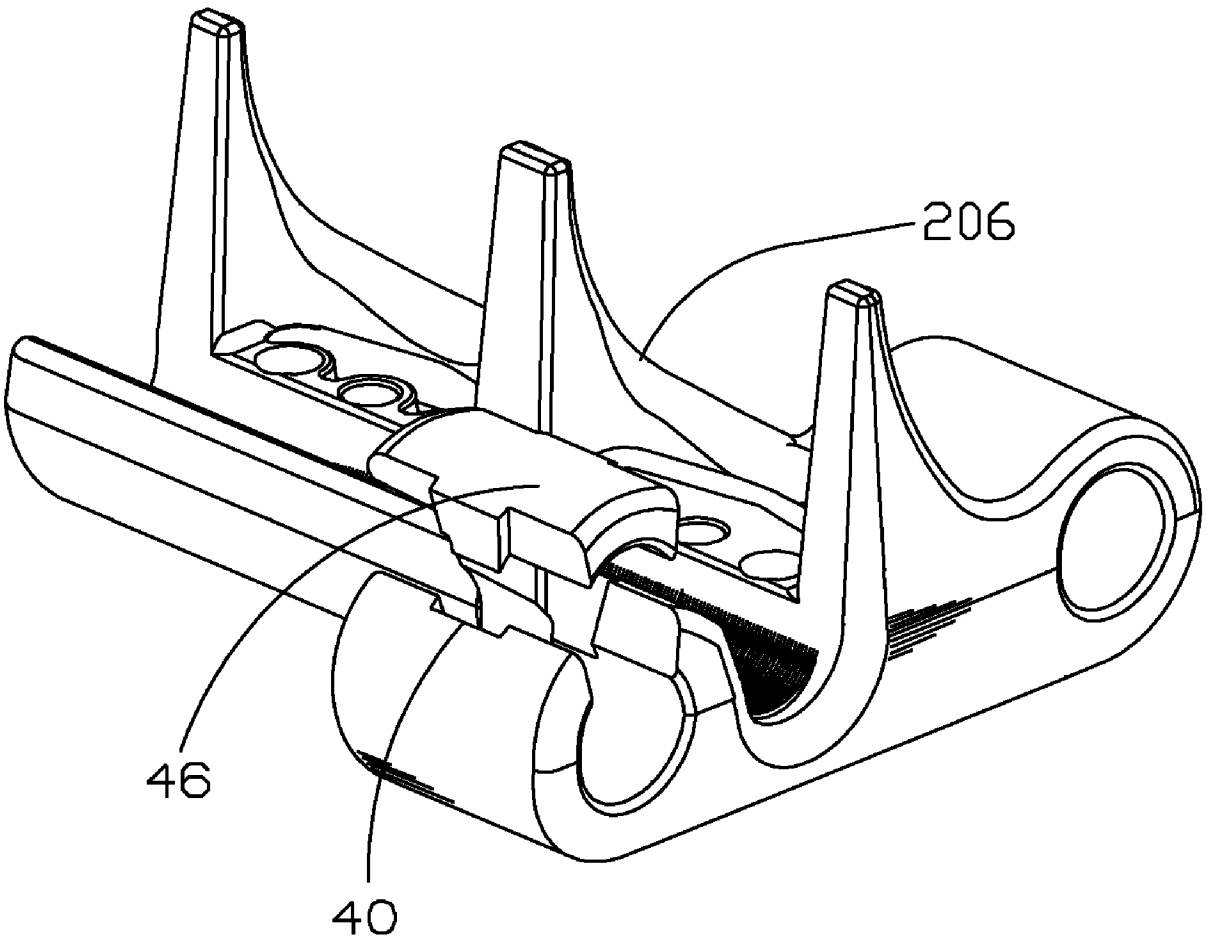
FIG. 13 is a perspective view of an end section of another embodiment of a repair device of the present disclosure.

In an alternative embodiment, referring to FIG. 13, the device 201 includes first and second end sections, which are generally similar to the end sections of the previous embodiments. The reverse tapered receiving bores 140 of end section 206 have circular configurations and include filler caps 46. Filler cap 46 allows the end sections to be molded without the use of a core or pull. During assembly, the filler caps are attached to the end sections by welding the filler caps thereto.

Figure 18:
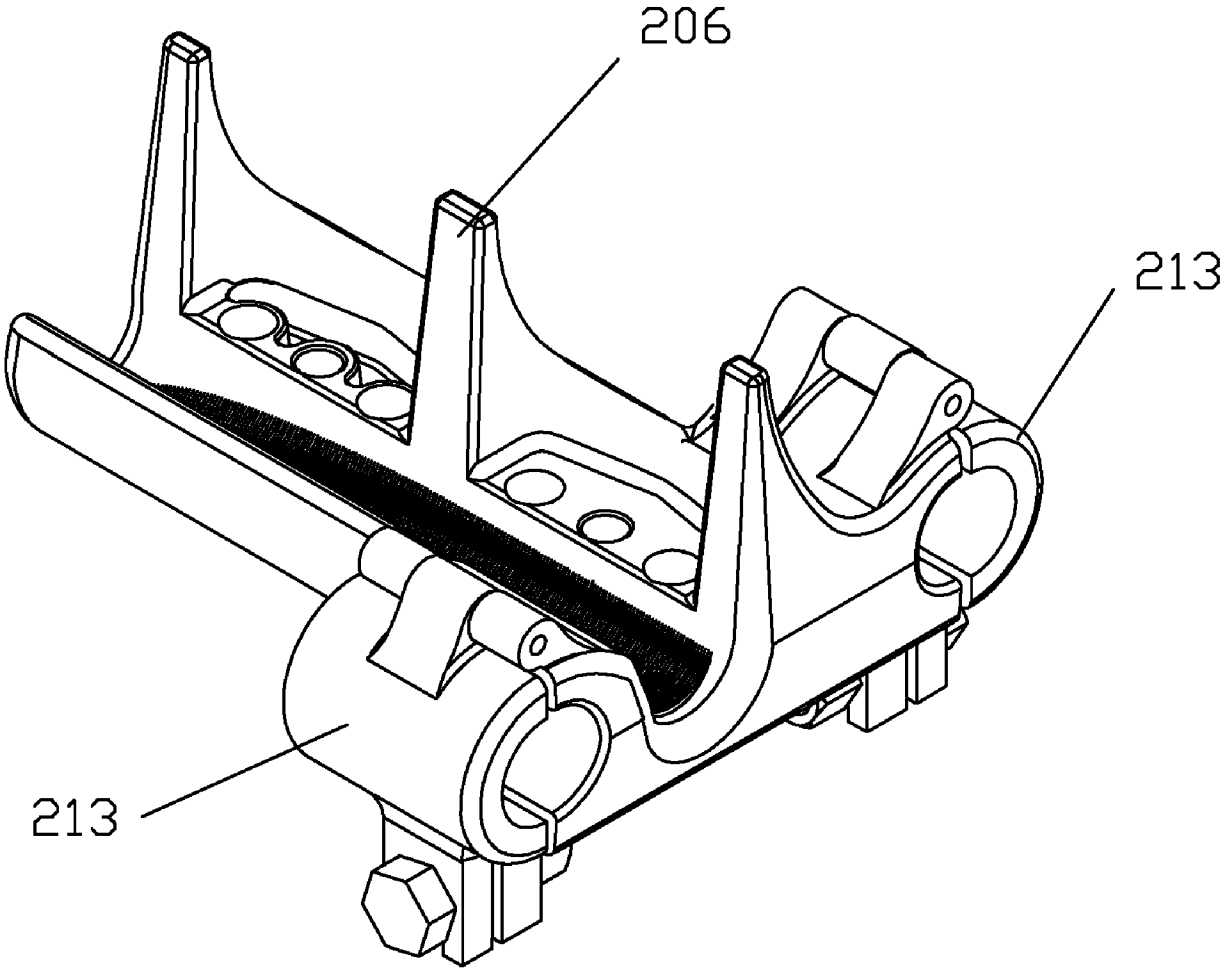
FIG. 18 is a perspective view of an end section of another embodiment of a repair device of the present disclosure.

In another embodiment, referring to FIG. 18, the end section 206 includes clamping mechanism 213 for attachment of the leg members. In other embodiments, the flexible leg members can be clamped to end sections by other mechanisms, such as wedge or cam type mechanisms, or compression devices which employ explosive, hydraulic or pneumatic pressure to plastically deform the flexible leg or the body for attachment. One advantage of utilizing attaching leg members is that the installer in the field can have the option of altering the length of the leg members.

Figure 14:
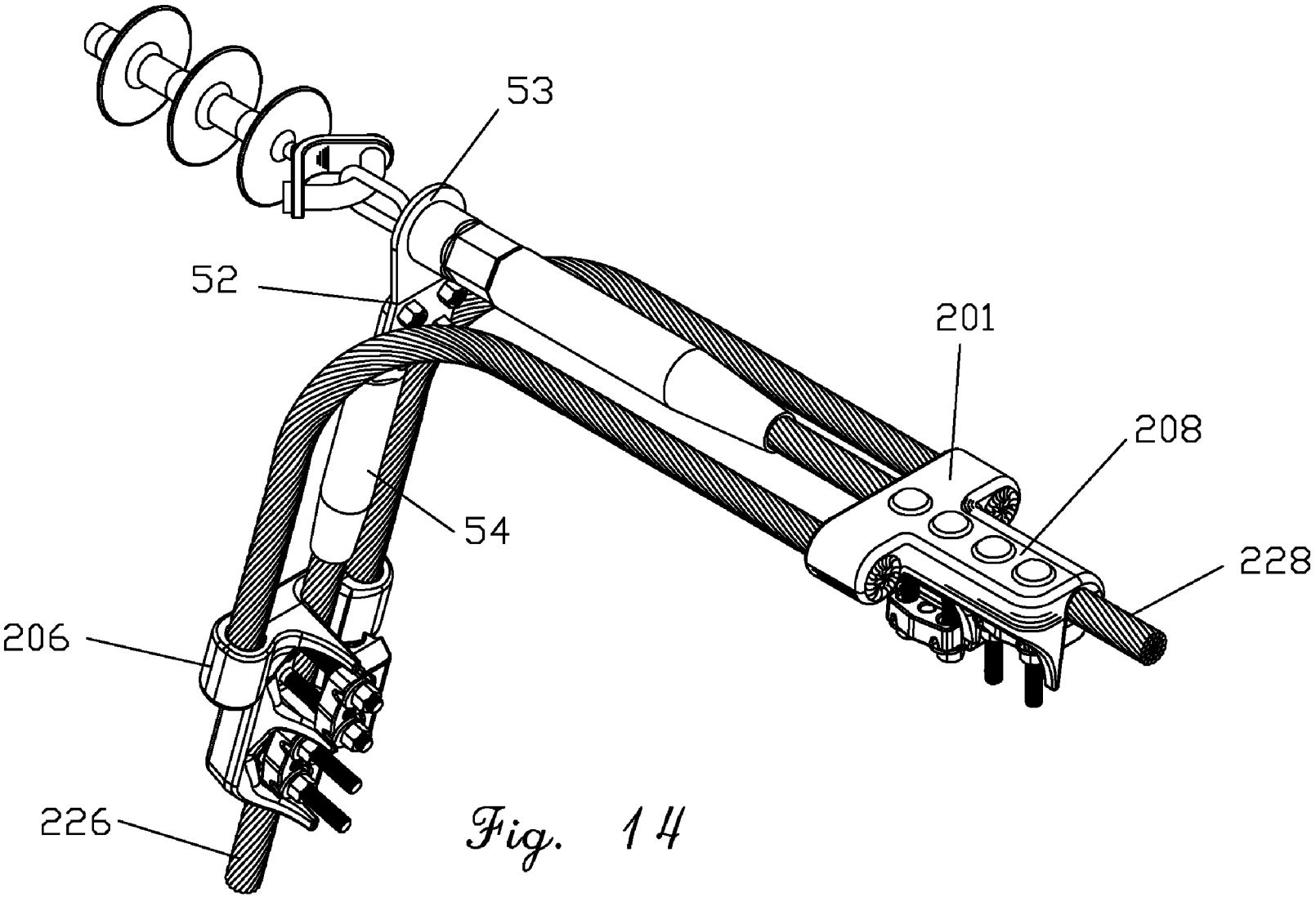
FIG. 14 is a perspective view of the device of FIG. 10, shown installed on a large subject cable having a conventional compression dead-end and terminal assembly.

Devices having flexible legs may be installed over existing splices, as illustrated in FIG. 10, or alternately, the devices can be bent to allow the device to be installed over a typical dead-end assembly, as illustrated in FIG. 14. Referring to FIG. 14, when the device 201 is attached to a dead-end assembly 53, the device is bent and end sections 206 and 208 are attached to exposed conductors 226, 228 extending from each of the respective ends of dead-end assembly 53. Device 210 provides a shunt for all three electrical interfaces of the dead-end connector, e.g., between the tensioned conductor 228 and the dead-end assembly 53, the bolted pads 52 between the dead-end and the terminal 54, and between the conductor 226 and the terminal 54.

Figure 15:
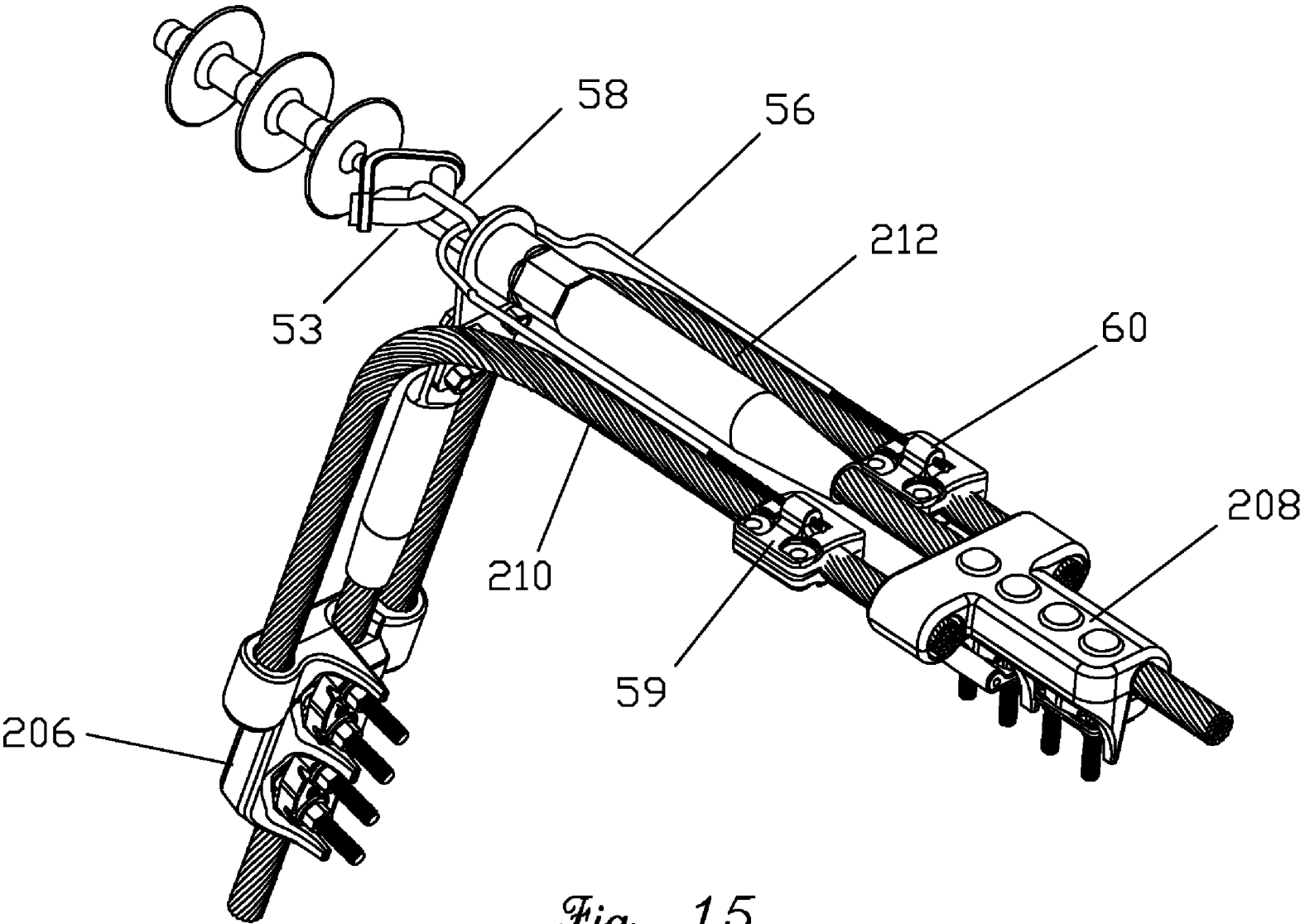
FIG. 15 is a perspective view of the device of FIG. 14, shown with a U-Bolt style safety device.

A safety device, such as the U-bolt 56 illustrated in FIG. 15, can be used to provide additional support. The safety device can be passed through the steel eye 58 of the dead-end connector or shackle assembly 53 and attached to legs 210 and 212 of device 201 by clamping elements 59, 60. Thus, the safety device substantially reduces the possibility of a dropped conductor, should the original dead-end assembly 53 fail mechanically.

Figure 16:
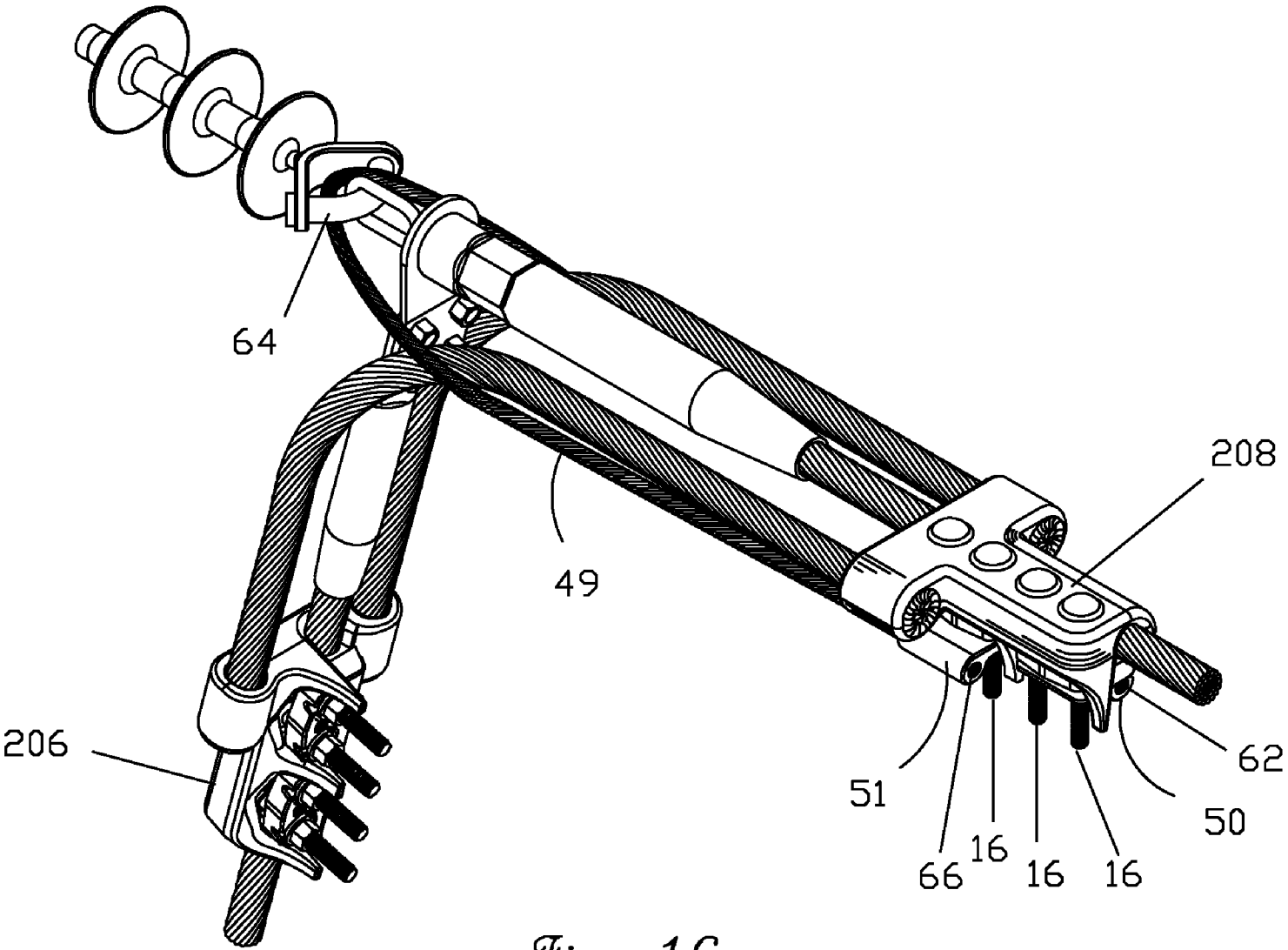
FIG. 16 is a perspective view of the device of FIG. 14 shown with a flexible cable safety tether.
Figure 17:
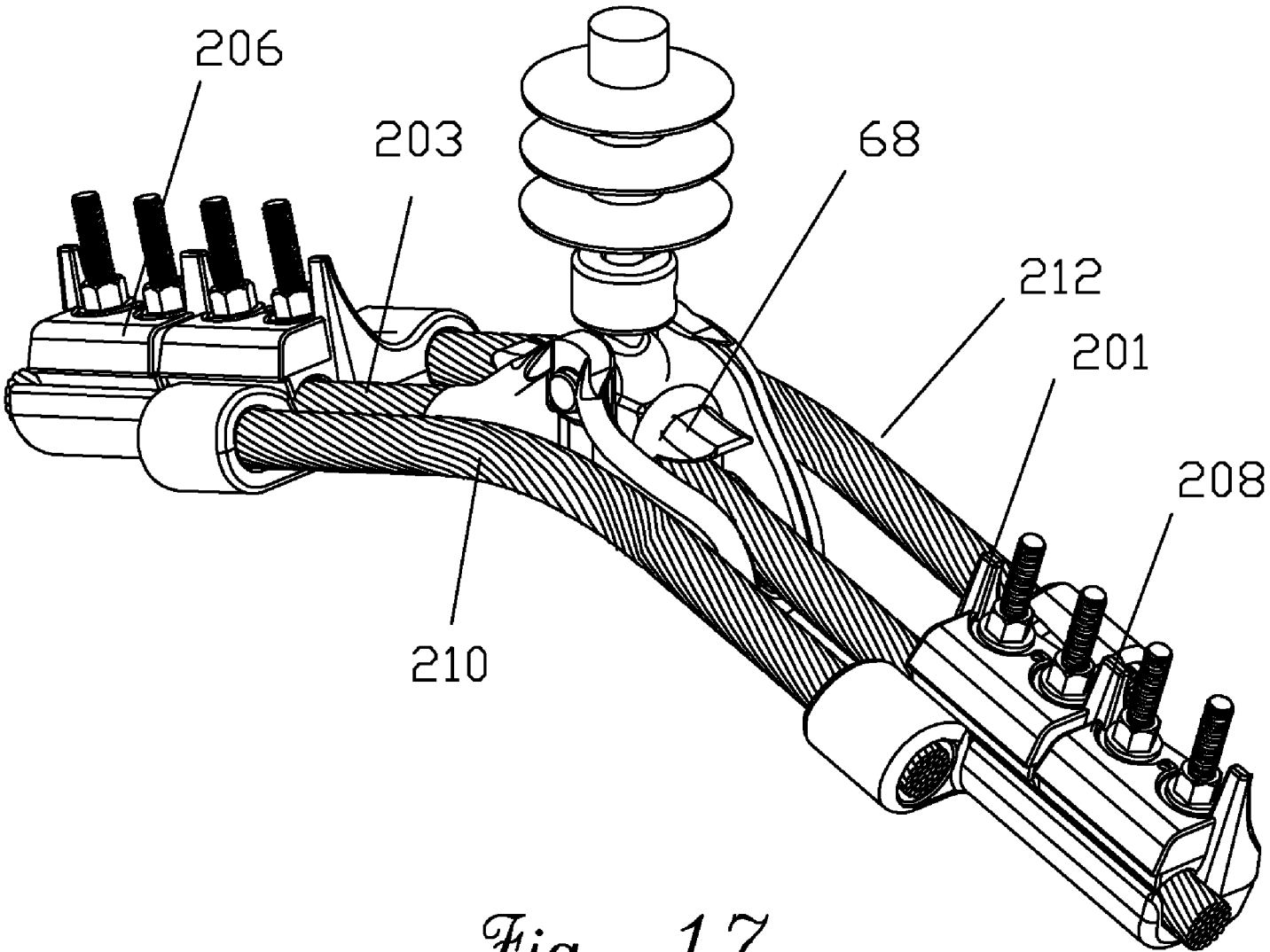
FIG. 17 is a perspective view of the device of FIG. 10, shown installed on a large subject cable nested in a conventional suspension clamp assembly.

The safety device can also be a flexible safety tether 49 as illustrated in FIG. 16. The safety tether 49 can be a stainless steel tether, such as a tether made from an aircraft grade stainless steel cable, or the like. The tether 49 has a first end 62 including an attachment member 50. The attachment member 50 can be attached to the bolts 16 of the outboard clamping member 22 and secured in position by nuts (not shown). The tether 49 is threaded through the clevis 64 or other end fitting on the insulator. The tether 49 includes a second end 66 having an attachment member 51. The attachment member 51 is attached to the bolt 16 of inboard clamping member 4 in a similar fashion described above. The flexible tether 49 substantially reduces the possibility of a dropped conductor, should the original dead-end fail mechanically.

The device described herein can also be used to restore the electrical and mechanical integrity of a compromised conductor, such as a conductor that has suffered broken strands in the proximity of a suspension clamp assembly. Damage to the strands can be due to Aeolian vibration, which causes fretting wear and/or fatigue of the strands. For example, referring to FIG. 17, during installation, end section 206 of device 201 is attached to the transmission line or conductor 203 at a location on one side of suspension clamp 68, and end section 208 is attached to transmission line 203 at a location on the other side of suspension clamp 68. Leg members 210, 212 of device 201 can be flexible members that allow the device to be bent along and flex with the contour of the transmission line 203. Alternatively, the leg members could be rigid members that are pre-bent at a desired angle.

Some suspension clamps are installed using a protective layer of helical rods laid over the cable to prevent abrasion of the cable in the suspension clamp. Also, certain suspension systems utilize a special design of suspension system that incorporates such helical rods in its design. In such situations, the repair device can include flexible legs of sufficient length to extend beyond these helical rods so that the end sections can be attached directly to the conductor. Alternatively, end sections 206 and 208 can be sized to clamp over the helical rods.

Figure 19:
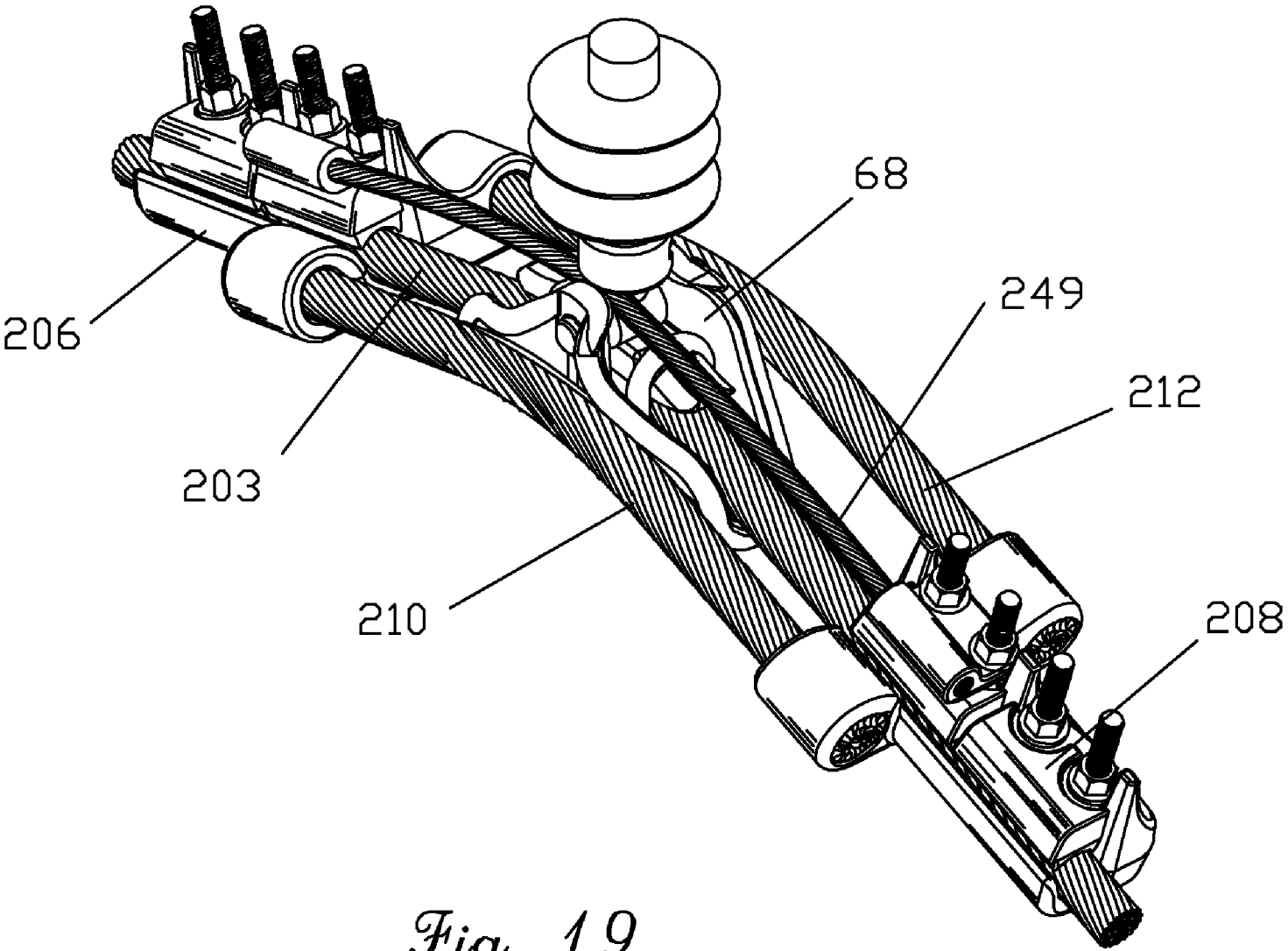
FIG. 19 is a perspective view of the device of FIG. 17, shown installed on a large subject cable nested in a conventional suspension clamp assembly and having a safety tether.

As illustrated in FIG. 19, a flexible safety tether 249, similar to that illustrated in FIG. 16, may be threaded through the suspension clamp 68 or its associated shackle assembly for the purpose of restoring the mechanical integrity to the conductor 203, should all, or too many of the strands inadvertently break. The safety tether substantially reduces the risk of a failing conductor falling to the ground.

Figure 20:
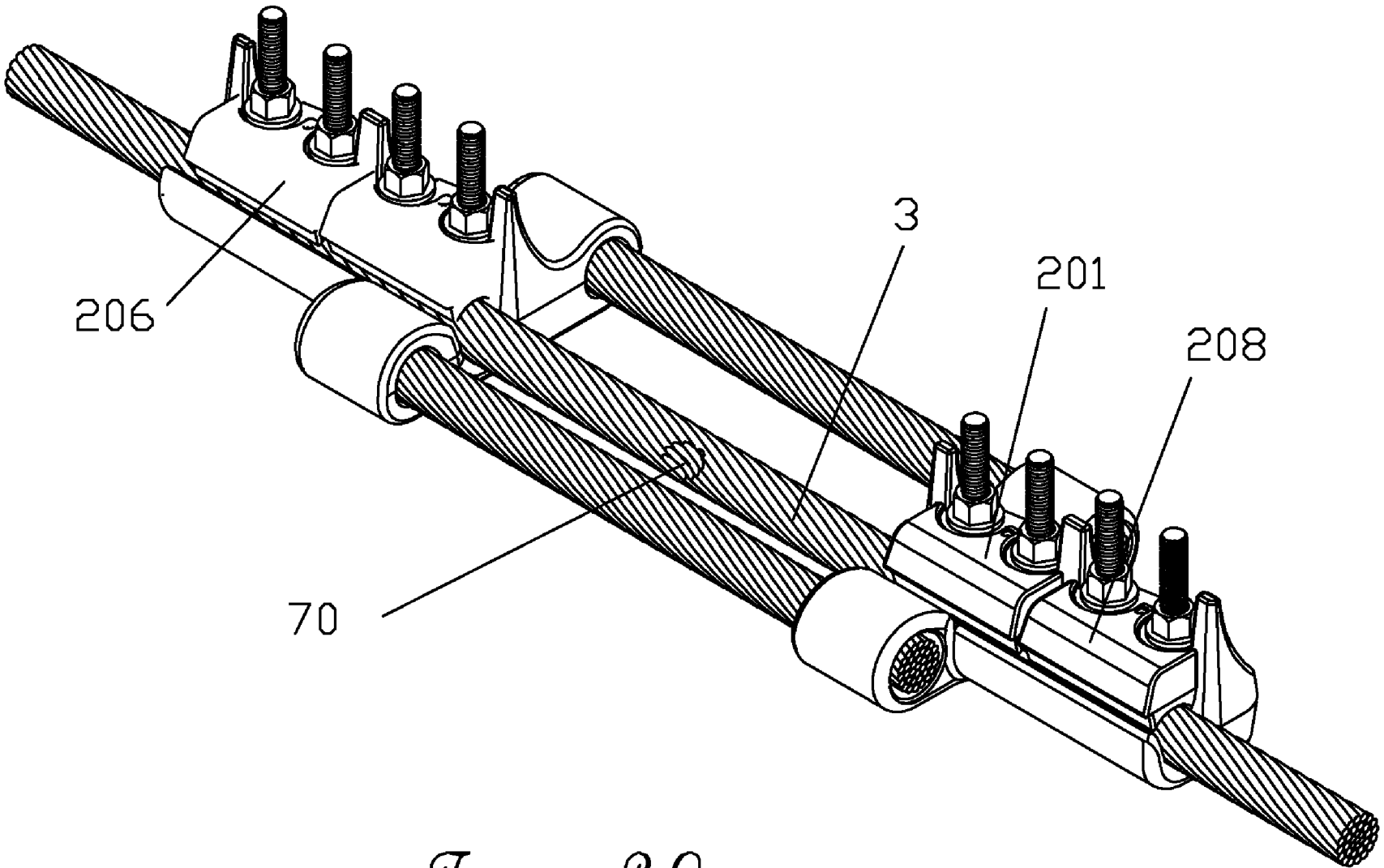
FIG. 20 is a perspective view of the device of FIG. 10 applied over damaged conductor.

In addition to being used to restore both the electrical and mechanical integrity of a transmission line in the area of a connector, such as a dead-end, splice or suspension clamp, any of the repair devices disclosed herein can be employed to restore the integrity of a compromised conductor by itself. FIG. 20 illustrates one embodiment of device 201 installed over a compromised section 70 of a conductor or transmission line 3. The conductor 3 can be compromised by deterioration or physical damage, such as by gunshot damage, lightning, or other potential hazards to the electrical conductor, such as abrasion from vibration dampers, or spacers. As shown, end section 206 is attached to the compromised conductor 3 at a location on one side of the damaged section 70 and end section 208 is attached to the compromised conductor 3 at a location on the other side of the damaged section 70. Once installed, device 201 provides a shunt or an alternative path for electrical current. Additionally, device 201 serves to provide mechanical integrity to the conductor, should the conductor fail, and reduces the risk of the conductor falling to the ground.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein. For example, while the repair device has been shown and described as combining both electrical and mechanical connections in the end sections and legs, there may be instances where it is preferable to separate these functions. That is, it may be that one leg is made of a material optimized for electrical conductivity while the other leg is made of material optimized for mechanical strength. Alternately, more than two legs may be provided with some legs intended primarily for electrical conduction and others intended primarily for mechanical strength.

What is claimed is:

1. A repair device for repairing a compromised section of an electrical transmission line, comprising:

a first end section having a first groove engageable with one side of a portion of a transmission line at a first location and a first clamping member engageable with a second side of said portion of the transmission line at said first location, the first clamping member being adjustably connected to the first end section for selectably increasing or decreasing the separation between the first clamping member and the first groove so as to clamp or release said portion of the transmission line at the first location between the first clamping member and the first groove, the first clamping member and the first end section being movable to a release position wherein they are still connected to one another and define an opening suitable for radial insertion of the transmission line between the first clamping member and the first groove;

a second end section having a second groove engageable with one side of a portion of a transmission line at a second location spaced from the first location and a second clamping member engageable with a second side of said portion of the transmission line at said second location, the second clamping member being adjustably connected to the second end section for selectably increasing or decreasing the separation between the second clamping member and the second groove so as to clamp or release said portion of the transmission line at the second location between the second clamping member and the second groove, the second clamping member and the second end section being movable to a release position wherein they are still connected to one another and define an opening suitable for radial insertion of the transmission line between the second clamping member and the second groove;

at least first and second electrically conductive leg members connected to the first and second end sections; and wherein the first and second leg members are connected to the first end section on opposite sides of the first groove, and the first and second leg members are connected to the second end section on opposite sides of the second groove.

2. The device of claim 1 wherein the leg members are integral with the first and second end sections.

3. The device of claim 1 wherein the first and second end sections include connector elements engageable with the leg member.

4. The device of claim 1 wherein the leg members are flexible.

5. The device of claim 1 wherein at least one of the grooves includes a textured contact surface.

6. An electrical connector repair device for restoring electrical and mechanical integrity to a compromised portion of an electrical transmission line, comprising:

a first end section, a second end section and an electrically conductive intermediate portion connected to the first and second end sections;

the first end section defining a first groove and having a first clamping member spaced apart from the first groove, the first clamping member and first end section being relatively movable toward and away from one another between open and closed positions and, when in the open position, the first clamping member and first end section are still connected to one another and define an opening suitable for radial insertion of the transmission line into the first groove and, when in the closed position, the first clamping member and first end section are configured to be clamped onto a first transmission line section located on one side of a compromised portion of the transmission line, the first end section configured to provide an electrical connection between the repair device and the first transmission line section;

the second end section defining a second groove and having a second clamping member spaced apart from the second groove, the second clamping member and second end section being relatively movable toward and away from one another between open and closed positions and, when in the open position, the second clamping member and second end section are still connected to one another and define an opening suitable for radial insertion of the transmission line into the second groove and, when in the closed position, the second clamping member and second end section are configured to be clamped onto a second transmission line section located on the other side of the compromised portion of the transmission line, the second end section configured to provide an electrical connection between the repair device and the second transmission line section; and the intermediate portion being disposed on opposite sides of the first and second grooves and providing a path for electrical current therethrough, and having sufficient structural strength to support the compromised portion of the transmission line.

7. The device of claim 6 wherein the intermediate portion is mechanically connected to the first and second end sections.

8. The device of claim 6 wherein the intermediate portion includes at least two leg members.

9. The device of claim 6 wherein the intermediate portion is flexible.

10. The device of claim 6 wherein at least one of the grooves includes a textured contact surface.

11. A device for repairing an electrical transmission line having a compromised section and first and second portions of the electrical transmission line located on either side of the compromised section, comprising:

first and second end sections, the first end section configured to be secured to the first portion of the transmission line and the second end section configured to be secured to a the second portion of the transmission line; and first and second electrically conductive elongated leg members each extending between the first and second end sections, each leg member being connected to the first and second end sections, the first and second portions of the transmission line being spaced from one another on opposite sides of the compromised section of the transmission line;

each of the first and second end sections including a top portion and a bottom portion which are connected to one another for relative movement between an opened position and a closed position and, in the open position, the top portion and bottom portion are spaced apart and define an opening suitable for radial insertion of the transmission line therebetween and, in the closed position, the top and bottom portions are moved toward each other so as to clamp an inserted transmission line therebetween; and each of the first and second end sections has at least two bolts connecting the top and bottom portions such that in the closed position each end section has sufficient structural strength to support the transmission line.

12. A device for reinforcing an electrical connector attached to an electrical transmission line, the electrical connector having a maximum exterior dimension greater than the diameter of the electrical transmission line, comprising:

a first end section having a transmission line-receiving first surface and a first clamping member connected to the first end section for movement toward and away from the first surface, such that the first end section is releasably attachable to a first portion of the transmission line located on one side of the electrical connector;

a second end section having a transmission line-receiving second surface and a second clamping member connected to the second end section for movement toward and away from the second surface, such that the second end section is releasably attachable to a second portion of the transmission line located on the other side of the electrical connector, the transmission line-receiving first and second surfaces being aligned axially with one another; and an electrically conductive intermediate section connected to the first and second end sections, the intermediate section being sufficiently offset transversely from and on both sides of the transmission line-receiving first and second surfaces so as to provide sufficient clearance between the intermediate section and the electrical connector to allow the first and second end sections to be attached to the first and second portions of the transmission with the electrical connector therebetween.

13. The device of claim 12 wherein the intermediate section comprises at least two leg members.

14. The device of claim 13 wherein the first and second end sections include connector elements engageable with the leg member.

15. The device of claim 13 wherein the leg members are integrally connected to the first and second end sections.

16. The device of claim 13 wherein the leg members are integrally connected to the first and second end sections.

17. The device of claim 13 wherein the leg members are flexible.

* * * * *

UNITED STATES PATENT AND TRADEMARK OFFICE

CERTIFICATE OF CORRECTION

PATENT NO. : 7,794,291 B2
APPLICATION NO. : 11/859924
DATED : September 14, 2010
INVENTOR(S) : Waymon P. Goch It is certified that error appears in the above-identified patent and that said Letters Patent is hereby corrected as shown below:

Title Page;

Item (54) Title is: ELECTRICAL TRANSMISSION LINE REPAIR SERVICE

Title should be: ELECTRICAL TRANSMISSION LINE REPAIR DEVICE

Signed and Sealed this
Twenty-second Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,794,291 B2
APPLICATION NO. : 11/859924
DATED : September 14, 2010
INVENTOR(S) : Waymon P. Goch It is certified that error appears in the above-identified patent and that said Letters Patent is hereby corrected as shown below:

Title Page, Item (54) and at Column 1, lines 1 and 2,

Title is: ELECTRICAL TRANSMISSION LINE REPAIR SERVICE

Title should be: ELECTRICAL TRANSMISSION LINE REPAIR DEVICE

This certificate supersedes the Certificate of Correction issued March 22, 2011.

Signed and Sealed this
Twenty-sixth Day of April, 2011

David J. Kappos

David J. Kappos
*Director of the United States Patent and Trademark Office*